US010094153B1

(12) United States Patent
Ploskunak

(10) Patent No.: US 10,094,153 B1
(45) Date of Patent: Oct. 9, 2018

(54) DOOR CLAMP

(71) Applicant: J. Robert Ploskunak, Murrysville, PA (US)

(72) Inventor: J. Robert Ploskunak, Murrysville, PA (US)

( * ) Notice: Subject to any disclaimer, the term of this patent is extended or adjusted under 35 U.S.C. 154(b) by 267 days.

(21) Appl. No.: 14/527,578

(22) Filed: Oct. 29, 2014

Related U.S. Application Data

(60) Continuation-in-part of application No. 13/549,562, filed on Jul. 16, 2012, now Pat. No. 8,899,639, which is a division of application No. 12/370,722, filed on Feb. 13, 2009, now Pat. No. 8,251,412, application No. 14/527,578, which is a continuation-in-part of application No. 13/914,536, filed on Jun. 10, 2013, now Pat. No. 9,279,278, which is a continuation-in-part of application No. 13/549,562, filed on Jul. 16, 2012, now Pat. No. 8,899,639, and a continuation-in-part of application No. 13/083,437, filed on Apr. 8, 2011, now Pat. No. 8,764,074, which is a continuation-in-part of application No. 12/370,722, filed on Feb. 13, 2009, now Pat. No. 8,251,412.

(51) Int. Cl.
*E05C 19/18* (2006.01)
*E05C 19/00* (2006.01)

(52) U.S. Cl.
CPC ..... *E05C 19/18* (2013.01); *E05C 19/007* (2013.01)

(58) Field of Classification Search
CPC ... B60J 7/104; B60J 7/102; B60J 7/141; B60J 7/10; B60J 7/198; B60J 11/00; B60J 7/1607; B60P 7/04; Y10S 135/907
See application file for complete search history.

(56) References Cited

U.S. PATENT DOCUMENTS 1,082,432 A * 12/1913 Mertsheimer ..... E05B 5/003 109/60
4,330,146 A * 5/1982 Sessions, Jr. ..... E05C 19/182 292/258
5,490,304 A * 2/1996 Winner, Jr. ..... E05F 5/06 16/82
5,542,723 A * 8/1996 Scharf ..... E05C 17/54 292/258
5,547,236 A * 8/1996 Gregory ..... E05C 19/182 292/148
7,338,098 B1 * 3/2008 O'Kelley ..... E05C 17/50 16/82

* cited by examiner

*Primary Examiner* — Mark A Williams
(74) *Attorney, Agent, or Firm* — Richard W. James

(57) ABSTRACT

Apparatuses and methods for securing a door. The apparatuses include a door clamp having a stop, a base, a jamb bracket, and a fastener and are used to clamp a door to prevent opening of the door.

11 Claims, 27 Drawing Sheets

DOOR CLAMP

CROSS-REFERENCE TO RELATED APPLICATIONS

The present application is a continuation-in-part of (1) U.S. patent application Ser. No. 13/549,562, filed Jul. 16, 2012, which is currently pending, and which claims priority to U.S. patent application Ser. No. 12/370,722, filed Feb. 13, 2009, which has issued as U.S. Pat. No. 8,251,412; and (2) U.S. patent application Ser. No. 13/914,536, filed Jun. 10, 2013, which is currently pending, and which claims priority to the aforementioned U.S. patent application Ser. No. 13/549,562, and to U.S. patent application Ser. No. 13/083,437, filed Apr. 8, 2011, which has issued as U.S. Pat. No. 8,764,074; those applications being incorporated herein in their entirety.

FIELD OF THE INVENTION

The present invention is concerned with securing a door. An embodiment of the invention secures a door against an intruder by clamping the door to adjacent structures.

BACKGROUND OF THE INVENTION

In certain circumstances, it may be desirable to have a locking mechanism that secures a door. Such a locking mechanism may, for example, be beneficial in a school when there is a lockdown situation where a user wishes to secure one or more doors.

In certain circumstances, such as in a school lock-down situation, room occupants may wish to secure doors to prevent entry into a room, for example. Moreover, the occupants may not have keys to the doors or time to secure the doors by way of keys and they may wish to secure the doors against persons who may have a key.

Accordingly, it may be desirable to have a locking or clamping mechanism that may secure one or more doors in their closed position to prevent the doors from being opened from the side of the doors opposite the locking or clamping mechanism. Such a door clamp could be self-contained, portable, and able to be secured and accessed by a limited number of people.

Such a door clamp may be used at schools, offices, post offices, hospitals, or any facility where doors are desired to be secured. The jamb lock door clamp described herein may thus provide security in situations, including lockdowns, where intruders must be prevented from entering a room.

Certain embodiments of the present door clamping mechanism provide apparatuses and methods to prevent access through a door from opposite where the door clamping mechanism is engaged with the door.

SUMMARY OF THE INVENTION

Embodiments of the invention are directed to methods and apparatuses for securing doors.

In accordance with one embodiment, the jamb lock door clamp includes a stop, a base, a jamb bracket, and a fastener. The stop has a width dimensioned to fit under a closed door such that the stop can be slid from an inner side of the door, under the door, and past an outer side of the door when positioned horizontally and having a length that extends along a surface of the door when positioned vertically. The base has a first end and a second end, the first end is fixedly attached to the stop and the base has a cross-section that, at its widest diameter, fits under the closed door and rotates under the closed door. The jamb bracket is fixedly attached to the second end of the base and dimensioned such that the jamb bracket extends along a surface of a door frame adjacent the inner side of the closed door when the stop is positioned vertically. The fastener is coupled to the jamb bracket to extend into a fastener hole when the jamb bracket is adjacent the door frame.

In accordance with one embodiment of the present invention, a method of sliding a stop under a closed door, the stop having a width dimensioned to fit under the closed door such that the stop can be slid under the door when positioned horizontally and having a length that extends along a surface of the door when positioned vertically; sliding at least part of a base, fixedly attached to the stop at a first end of the base, under the closed door, the base having a cross-section that, at its widest diameter, fits under the closed door and rotates under the closed door; rotating the base so that the base extends along a surface of the door; moving a jamb bracket, fixedly attached to a second end of the base and dimensioned such that the jamb bracket extends along a surface of a door frame adjacent the inner side of the closed door when the stop is positioned vertically, to extend along the surface of the door frame adjacent the inner side of the closed door; and extending a fastener coupled to the jamb bracket into a fastener hole disposed in a fastener bracket attached to at least one of a floor adjacent the closed door, a door jamb, and a wall 221 adjacent the door jamb, when the jamb bracket extends along the surface of the door frame adjacent the inner side of the closed door.

In accordance with another embodiment, a door clamping device is disclosed that includes a first jamb bracket attached to a second jamb bracket by a hinge, with a first base and a first stop extending from the first jamb bracket and a second base and a second stop extending from the second jamb bracket. The first jamb bracket has a first end and a second end and the second jamb bracket has a first end and a second end. The hinge has an axis and is rotatably attached to the first end of the first jamb bracket and the first end of the second jamb bracket such that the first and second jamb brackets can be placed in an extended position in which the second end of the first jamb bracket and the second end of the second jamb bracket are positioned away from one another and the first and second jamb brackets can be placed in a folded position in which the second end of the first jamb bracket and the second end of the second jamb bracket are positioned adjacent one another. The first base extends from the second end of the first jamb bracket and the second base extends from the second end of the second jamb bracket with the first stop attached to the first base and the second stop attached to the second base such that the first stop and second stop can be disposed under a door when the door clamping device is in a folded configuration, and the first stop and second stop can be disposed along the outer surface of the door when the first and second jamb brackets are placed in the extended position, thereby clamping the door. The door clamping device may include a fastener placed in a fastener orifice such that when the first and second jamb brackets are placed in the extended position under a door, a fastener or pin can be placed through the fastener orifice and extend into a fastener hole, which may be in a floor adjacent the door.

In accordance with another embodiment, a method of installing a door clamping device includes placing the door clamping device in a folded position, the door clamping device comprising a first jamb bracket having a first end and a second end, a second jamb bracket having a first end and a second end, a hinge having an axis and rotatably attached to the first end of the first jamb bracket and the first end of the second jamb bracket such that the first and second jamb brackets can be placed in an extended position in which the second end of the first jamb bracket and the second end of the second jamb bracket are positioned away from one another and the first and second jamb brackets can be placed in a folded position in which the second end of the first jamb bracket and the second end of the second jamb bracket are positioned adjacent one another, a first base extending from the second end of the first jamb bracket, a second base extending from the second end of the second jamb bracket, a first stop attached to the first base and a second stop attached to the second base. The method further includes placing the first stop and the second stop and the first base and the second base of the door clamping device under a door until the first jamb bracket and the second jamb bracket are adjacent an inner surface of the door with the door clamping device in the folded position, moving the door clamping device into its extended position such that the first stop and the second stop extend along an outer surface of the door, and placing a fastener through the door clamping device into a fastener hole in a floor adjacent the door.

In accordance with another embodiment, a door clamping device for installation from the inside of a room and for preventing an inward swinging door from swinging into the room is disclosed that includes a stop, a base, a jamb bracket, and a fastener. In that embodiment, the stop has a width dimensioned to extend adjacent an inner side of a door frame and has a stop extension that has a height dimensioned to extend adjacent an inner side of the door. The base has a first end and a second end, the first end fixedly attached to the stop and the base has a height that fits under the closed door. The jamb bracket is fixedly attached to the second end of the base and dimensioned such that the jamb bracket and base can be slid from an inner side of the door, under the door, until the stop extension is adjacent the inner side of the door, and the base can be moved adjacent the door frame until the jamb bracket extends along the door frame. the fastener of that embodiment is coupled to the stop to extend into a fastener hole when the stop extends adjacent the door frame.

In yet another embodiment, a method of keeping a door closed is provided that includes positioning a stop portion of a door clamp horizontally, the door clamp having a base attached to a fastener bracket and the stop, sliding the stop portion of the door clamp under the closed door and past an outer side of the closed door, rotating the door clamp such that the stop portion is vertical, moving the door clamp toward a door frame such that the base is positioned at least partially under the door and the fastener bracket is positioned on an inner side of the door, and placing a pin extending through the door clamp into a fastener orifice, thereby maintaining the door closed by a limitation of movement of the pin in the fastener orifice.

Accordingly, the present invention provides solutions to the shortcomings of prior door securing systems, apparatuses, and methods. Those of ordinary skill in the art will readily appreciate, therefore, that those and other details, features, and advantages of the present invention will become further apparent in the following detailed description of the preferred embodiments of the invention.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of embodiments of jamb lock door clamping devices and methods of securing a door.

DETAILED DESCRIPTION OF THE INVENTION

Jamb lock door clamping apparatuses and methods of securing one or more doors are described herein. Reference will now be made to embodiments of those door clamping apparatuses and methods of securing one or more doors, examples of which are illustrated in the accompanying drawings. Details, features, and advantages of the jamb lock door clamp will become further apparent in the following detailed description of embodiments thereof. It is to be understood that the figures and descriptions included herein illustrate and describe elements that are of particular relevance to jamb lock door clamping apparatuses and methods of securing one or more doors while eliminating, for purposes of clarity, other elements found in typical door systems.

Any reference in the specification to "one embodiment," "a certain embodiment," or any other reference to an embodiment is intended to indicate that a particular feature, structure or characteristic described in connection with the embodiment is included in at least one embodiment and may be utilized in other embodiments as well. Moreover, the appearances of such terms in various places in the specification are not necessarily all referring to the same embodiment. References to "or" are furthermore intended as inclusive so "or" may indicate one or another of the ored terms or more than one ored term.

Figure 1:
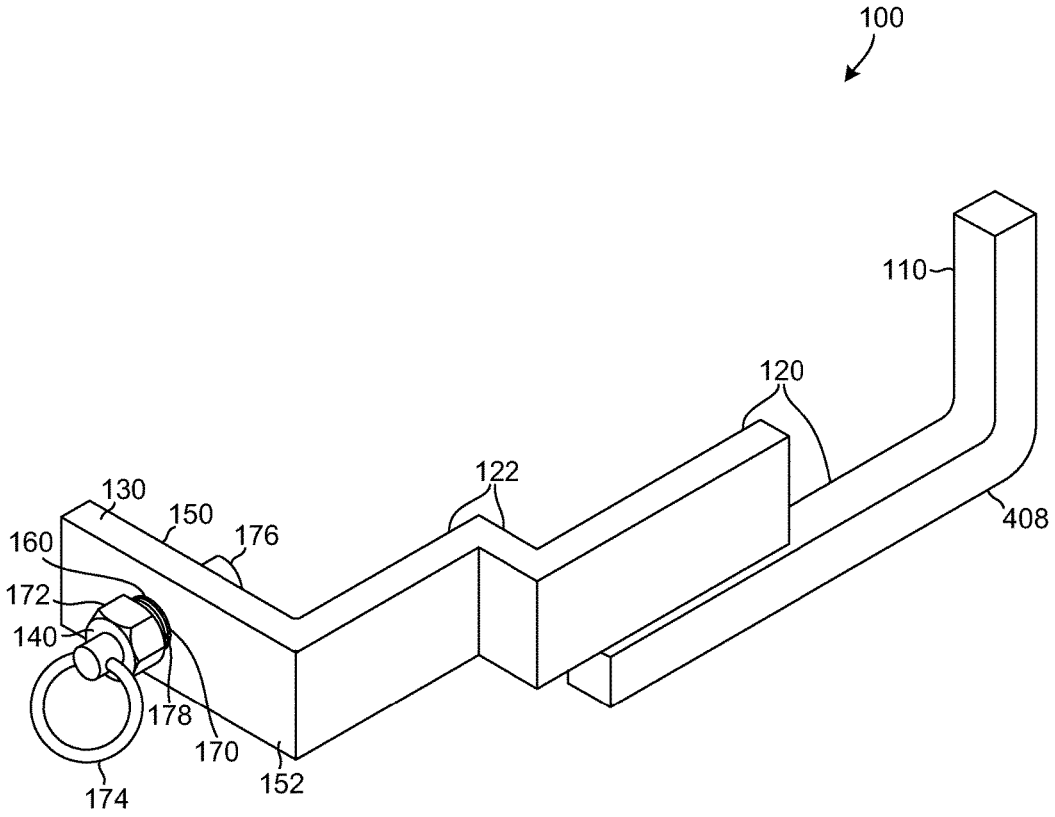
FIG. 1 illustrates an isometric view of an embodiment of a jamb lock door clamp.

FIG. 1 illustrates an isometric view of a jamb lock door clamp 100. The jamb lock door clamp 100 includes a stop 110, a base 120, a jamb bracket 130, and a fastener 140. The door clamp 100 also has an inner side 150 and an outer side 152.

The stop 110 depicted in FIG. 1 is arranged at approximately a 90° or right angle to the base 120 such that the stop 110 may extend along or near an outer surface of a door while the base 120 is situated under the door. The jamb bracket 130 is also arranged at a 90° or right angle to the base 120 and perpendicular to the stop 110 such that the jamb bracket 130 may extend along an inner surface of a door jamb while the base 120 is situated under the door and the stop 110 extends along the door. Alternately, the stop 110 and the jamb bracket 130 may be configured in relation to the base 120 as desired to suit a desired door configuration.

The base 120 illustrated in FIG. 1 includes an angled portion 122 contoured to fit against certain doors. As will be seen in connection with door clamp 400 illustrated in FIG. 5, such an angled portion is optional.

A fastener orifice 160 may be created in the jamb bracket 130. The fastener orifice 160 may be a threaded hole such that a threaded portion 178 of a holding pin 170 may be positioned through the fastener orifice 160, as illustrated in FIG. 1. The holding pin 170 may furthermore extend through the fastener orifice 160 and extend past the inner side 150 of the jamb bracket 130.

Alternately or in addition, the fastener orifice 160 in the jamb bracket 130 may be arranged such that a holding pin 170 may be positioned through the fastener orifice 160 in such a way that the holding pin 170 may extend into a floor 219, a bracket 223 attached to a door frame 220, a wall 221 adjacent the door frame 220, or another desired surface or apparatus.

In an embodiment, the holding pin 170 is a threaded pin with a plunger 176 of the pull-ring, lever, T-handle or other desired type disposed therein. That type of holding pin 170 includes a spring-biased plunger 176 that extends through the threaded portion 178 of the holding pin 170. In such an embodiment, the threaded portion 178 of the holding pin 170 may be threaded into the fastener orifice 160 but not through the inner side 150 of the door clamp 100. The spring-biased plunger 176 may then be pulled against the bias of the spring so that the spring-biased plunger 176 does not extend through the inner side 150 of the door clamp 100 and, when the door clamp 100 is properly positioned, the spring-biased plunger 176 may be released so that the spring-loaded plunger 176 extends through the inner side 150 of the door clamp 100.

The holding pin 170 may have one or more portions formed for ease of turning the holding pin 170 and thereby threading the holding pin 170 through the fastener orifice 160. For example, as shown in FIG. 1, the threaded portion 178 of the holding pin 170 may include a hex head 172 of the type that is frequently turned using a wrench.

Also as shown in FIG. 1, the holding pin 170 may have one or more portions formed to facilitate pulling the spring-biased plunger 176 against the spring-bias, such as the ring 174.

Figure 2:
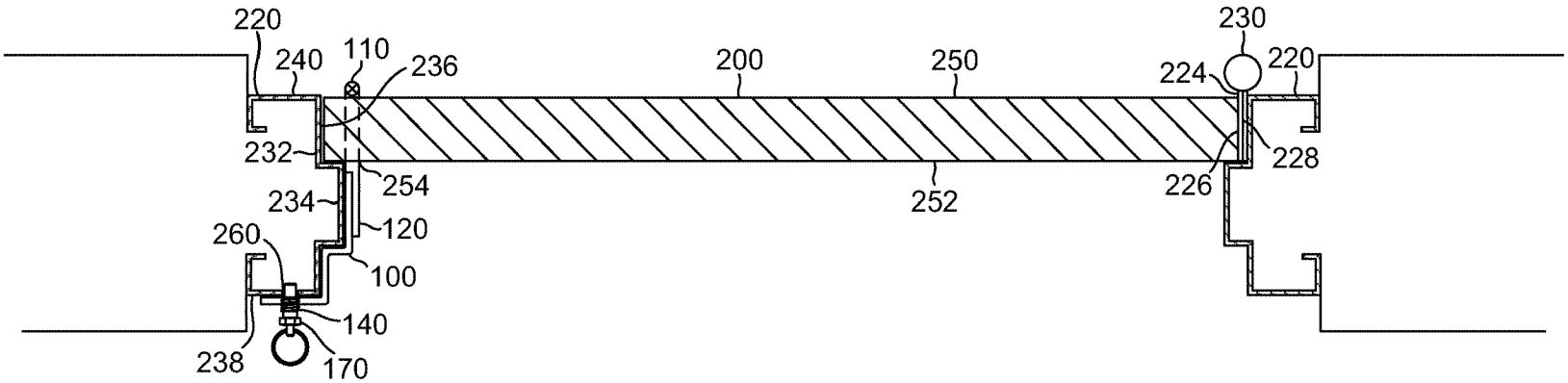
FIG. 2 illustrates a top view of an embodiment of a door and frame with the door clamp of FIG. 1 applied thereto.

FIG. 2 illustrates a top view of an embodiment of a door 200 and frame 220 with a jamb lock door clamp 100 affixed thereto. The door 200 is attached to the frame 220 by hinges 224. The door 200 may be attached by any desired number of hinges 224, from 2 to 4 or more. The hinges 224 typically include two halves, a door side hinge 226 and a frame side hinge 228, coupled by a hinge pin 230 such that the door side hinge 226 and the frame side hinge 228 rotate around the hinge pin 230, permitting the door 200 to swing open in one direction and closed in the opposite direction. The hinges 224 are commonly attached to the door 200 and the frame 220 by screws, but may be attached in any way desired.

The door 200 latches into a latch side jamb 232 portion of the frame 220. A strip 234 extends from the frame 220 or is formed in the frame 220 to stop the door 200 when the door 200 is closed. The door frame 220 further includes a facing surface 236 adjacent the door 200 when the door 200 is closed, an inner surface 238, and an outer surface 240.

The door 200 has an outer side 250 facing the direction in which the door swings open and an inner side 252 facing the direction toward which the door 200 swings closed. An edge 254 of the inner side 252 of the door 200 thus rests adjacent the strip 234 when the door is closed.

A fastener hole 260 may be created in the door frame 220, a floor 219 adjacent the door 200, a fastener bracket 960 attached to the door frame 220, a wall 221 adjacent the door frame 220, or another desired surface or apparatus, for positive engagement of the door clamp 100 to the door frame 220, floor 219, fastener bracket 960, wall 221, or other desired surface or apparatus. The fastener hole 260 in the door frame 220 may be created in various ways. For example, the fastener hole 260 may be created by positioning the jamb lock door clamp 200 and marking the hole through the fastener orifice 160 with a scriber, pencil, or other marking instrument. Then the jamb lock door clamp 200 may be removed and a hole may be drilled or otherwise formed in the door frame 220, floor 219, fastener bracket 960, wall 221, or other desired surface or apparatus, at the mark so that the holding pin 170 can extend into the door frame 220, floor 219, fastener bracket 960, wall 221, or other desired surface or apparatus, when the jamb lock door clamp 100 is positioned in its locking position. It should be noted that the fastener hole 260 in the door frame 220, floor 219, fastener bracket 960, wall 221, or other desired surface or apparatus, may be threaded, but need not necessarily be threaded to secure the jamb lock door clamp 100 in place by way of the holding pin 170 because movement of the jamb lock door clamp 100 lengthwise along the base 120 is limited by the stop 110 contacting the outer side 250 of the door 200, which minimizes the likelihood that the holding pin 170 will move out of the fastener hole 260 during an attempted entry into the room.

Figure 3:
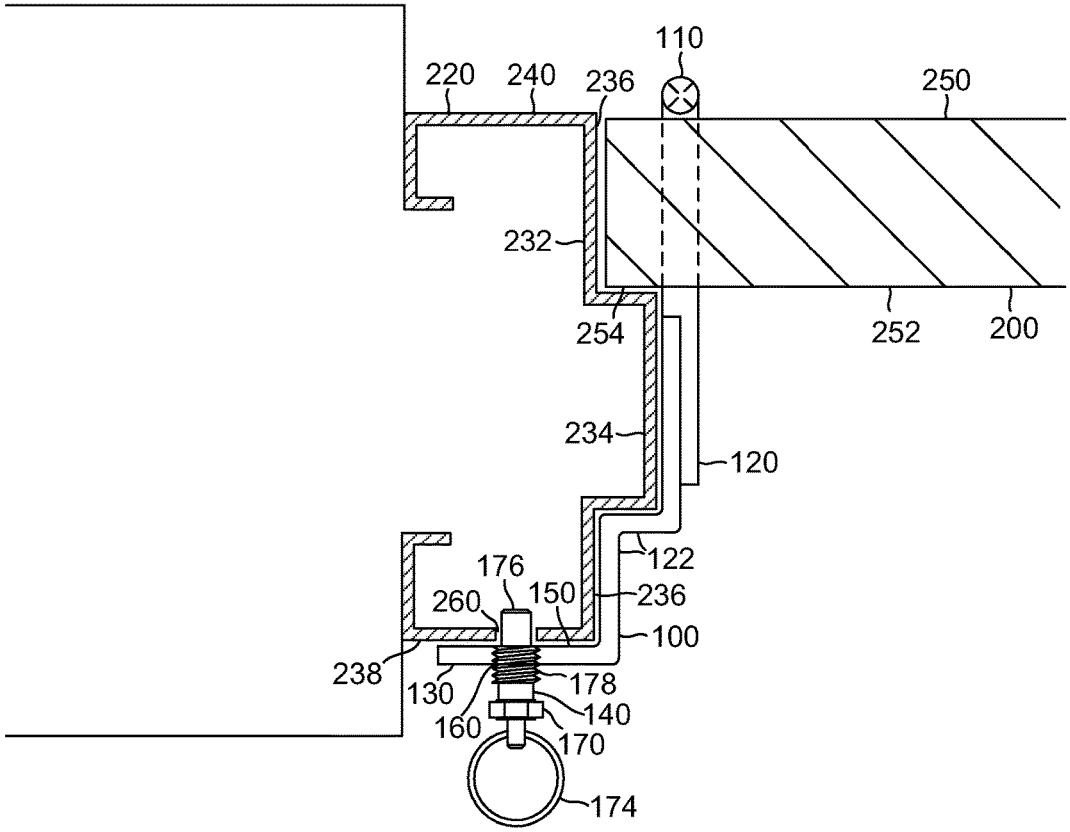
FIG. 3 illustrates an enlarged top view of a portion of the door and frame with the door clamp attached thereto, depicted in FIG. 2.

FIG. 3 is an enlarged view of a portion of the door 200 and frame 220 depicted in FIG. 2 having the jamb lock door clamp 100 affixed thereto. The door clamp 100 may be shaped as desired to fit any desired door. For example, the door clamp 100 depicted in FIGS. 1, 2, and 3 has a bend 122 in the base 120 to fit around the strip 234 attached to a door frame 220. In that embodiment, the bend 122 of the base 120 extends along the strip 234 and facing surface 236 of the frame 220. The jamb bracket 130 turns perpendicular to the base 120 to extend along the inner surface 238 of the door frame 220. In that embodiment, the holding pin 170 extends perpendicular to the inner side 252 and outer side 250 of the door 200 through the jamb bracket 130 and into the door frame 220. In another embodiment, the holding pin 170 may extend parallel to the inner side 252 and outer side 250 of the door 200 through the door clamp 100 and into the floor 219 below or adjacent to the door 200. In other embodiments, the holding pin 170 may extend in a desired direction into a fastener bracket 960 attached to the door frame 220, the floor 219, the wall 221 adjacent the door frame 220, or into another surface or apparatus as desired. In such embodiments, the holding pin 170, when inserted into the fastener hole 260, prevents the door 200 from opening by minimizing the distance the jamb lock door clamp 100 may move.

The jamb lock door clamp 100 may be used to secure a door, such as the door 200 illustrated in FIG. 2, quickly and easily. In an embodiment of door clamp 100 operation, the door clamp 100 depicted in FIG. 1 is positioned on the floor near the door 200. The door clamp 100 is positioned such that the stop 110 of the door clamp 100 is horizontal. The stop 110 is then slid under the door 200 and past the outer side 250 of the door 200. Once the stop 110 is extended past the outer side 250 of the door 200, the door clamp 100 is rotated 90° so that the stop 110 is vertical. The door clamp 100 is then moved to adjacent the door frame 220. As may be seen in FIG. 2, the stop 110 of the door clamp 100 may be positioned against the side of the door frame 220 opposite the hinges 224 that swings away from the door frame 220. The holding pin 170 may then be placed against or extended into the door frame 220, the floor 219, the wall 221 adjacent the door frame 220, a fastener bracket 960, or into another surface or apparatus as desired.

Figure 22:
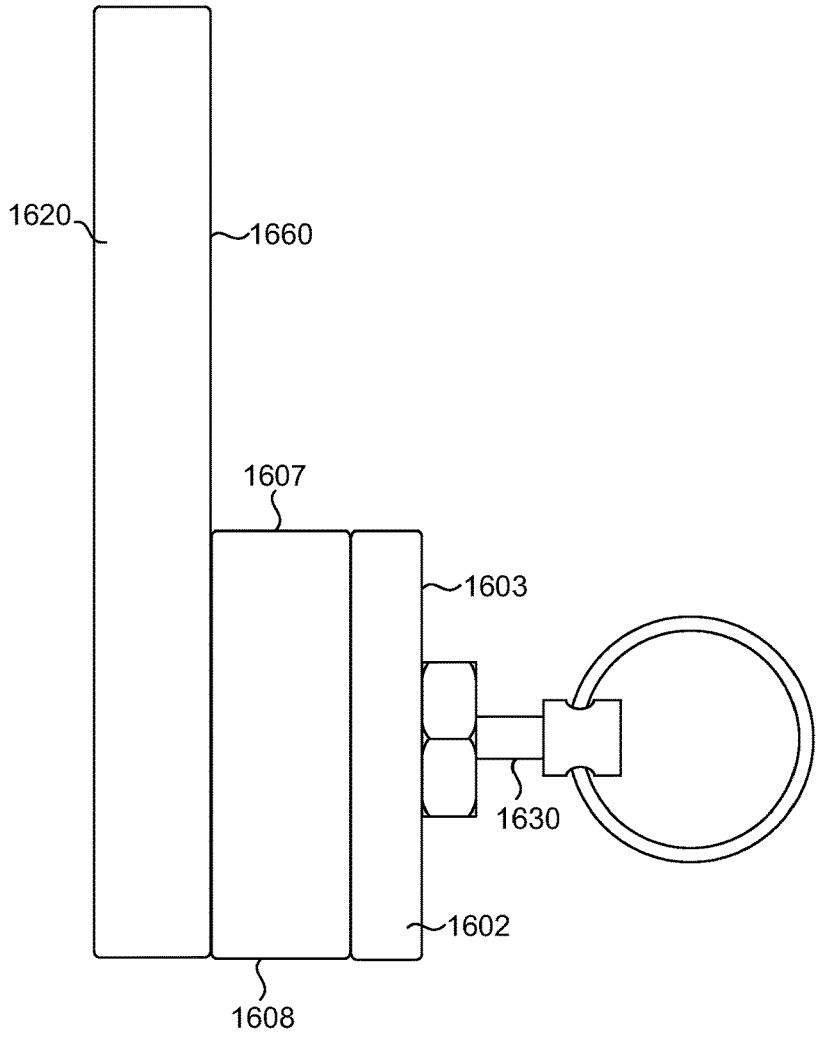
FIG. 22 illustrates a side view of an embodiment of a door clamp in an unsecured deployment.

As may be seen in FIG. 3, the holding pin 170 may be placed through the door clamp 100 as desired, including by threading a portion 178 of the holding pin 170 into the door clamp 100. The holding pin 170 may furthermore extend through the door clamp 100 into the door frame 220, the floor 219, the wall 221 adjacent the door frame 220, a fastener bracket 960, or into another surface or apparatus as desired by pulling the spring-biased plunger 176 of the holding pin 170 until the spring-biased plunger 176 of the holding pin 170 is nearly flush with the inner surface 150 of the door clamp 100, moving the door clamp 100 toward or against the door frame 220 so that the holding pin 170 is aligned with the fastener hole 260 in the door frame 220, the floor 219, the wall 221 adjacent the door frame 220, the fastener bracket 960, or into another surface or apparatus as desired, and releasing the spring biased plunger 176 of the holding pin 170 when the holding pin 170 is held back against the spring bias as is shown in FIG. 22 or is near the fastener hole 260 such that the spring biased plunger 176 extends into the fastener hole 260 in the door frame 220, the floor 219, the wall 221 adjacent the door frame 220, fastener bracket 960, or into another surface or apparatus as desired when the holding pin 170 is aligned with the fastener hole 260. In an embodiment, the spring-biased plunger 176 of the holding pin 170 may be released when the plunger 176 rests against a surface into which the fastener hole 260 is created and then the door clamp 100 can be moved until the holding pin 170 extends into the fastener hole 260, which may be accompanied with a sound created by sudden spring actuated movement of the holding pin 170 into the fastener hole 260.

Thus, the threaded portion 178 of the holding pin 170 may be screwed into the door clamp 100 by hand, wrench or as desired, or otherwise be fastened to the door clamp 100, and remain there when the door clamp 100 is not in use. Then, when the door clamp 100 is used, the person positioning the door clamp 100 may pull the spring-biased plunger 176 using the ring 174 or otherwise as desired, until the holding pin 170 is in contact with the door frame 220, floor 219, wall 221 adjacent the door frame 220, fastener bracket 960, or another surface or apparatus in which the fastener hole has been formed. The user may then release the spring-biased plunger 176 and move the door clamp 100 until the holding pin 170 is aligned with the fastener hole 260 and the spring-biased plunger 176 extends into the fastener hole 260.

Figure 4:
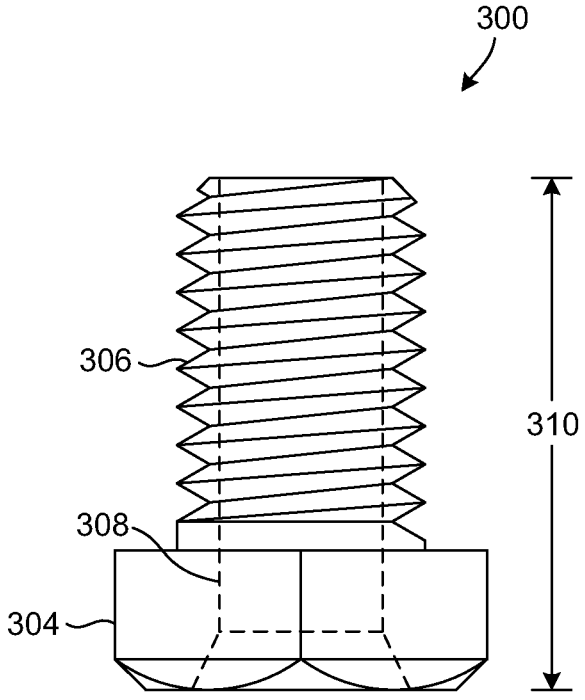
FIG. 4 illustrates a side view of a hollow bolt guide.

FIG. 4 illustrates a hollow guide 300 that may be used when creating the fastener hole 260 in the door frame 220. The hollow guide 300 may be in the form of a standard machine threaded bolt, axially bored through the hollow guide 300. Thus the hollow guide 300 depicted in FIG. 4 is bored longitudinally through the center and for the length of the hollow guide 300. The hollow guide 300 embodiment depicted in FIG. 4 includes a hex head 304, an externally threaded shaft 306, and an axial bore 308 through the longitudinal length 310 of the hollow guide 300.

In operation, the hollow guide 300 may be threaded into the fastener orifice 160 of the jamb lock door clamp 100. The door clamp 100 may then be positioned against a door 200 and door frame 220, floor 219, wall 221, fastener bracket 960, or other desired surface or apparatus and the hollow guide 300 may be tightened against the door frame 220, the floor 219, the wall 221 adjacent the door frame 220, or another surface or apparatus in which the fastener hole 260 is to be formed. Next, a fastener hole 260 may be bored into the door frame 220, the floor 219, the wall 221 adjacent the door frame 220, the fastener bracket 960, or another surface or apparatus in which the fastener hole 260 is to be formed, through the hollow guide 300 by any means desired. In an embodiment, the fastener hole 260 is drilled into the door frame 220, the floor 219, the wall 221 adjacent the door frame 220, the fastener bracket 960, or another surface or apparatus in which the fastener hole 260 is to be formed using a drill having a bit that extends through the hollow guide 300. After the fastener hole 260 has been formed in the door frame 220, the floor 219, the wall 221 adjacent the door frame 220, the fastener bracket 960, or another surface or apparatus in which the fastener hole 260 is to be formed, the hollow guide 300 may be removed from the door clamp 100 and the holding pin 170 may be threaded into the door clamp 100 in place of the hollow guide 300.

Figure 5:
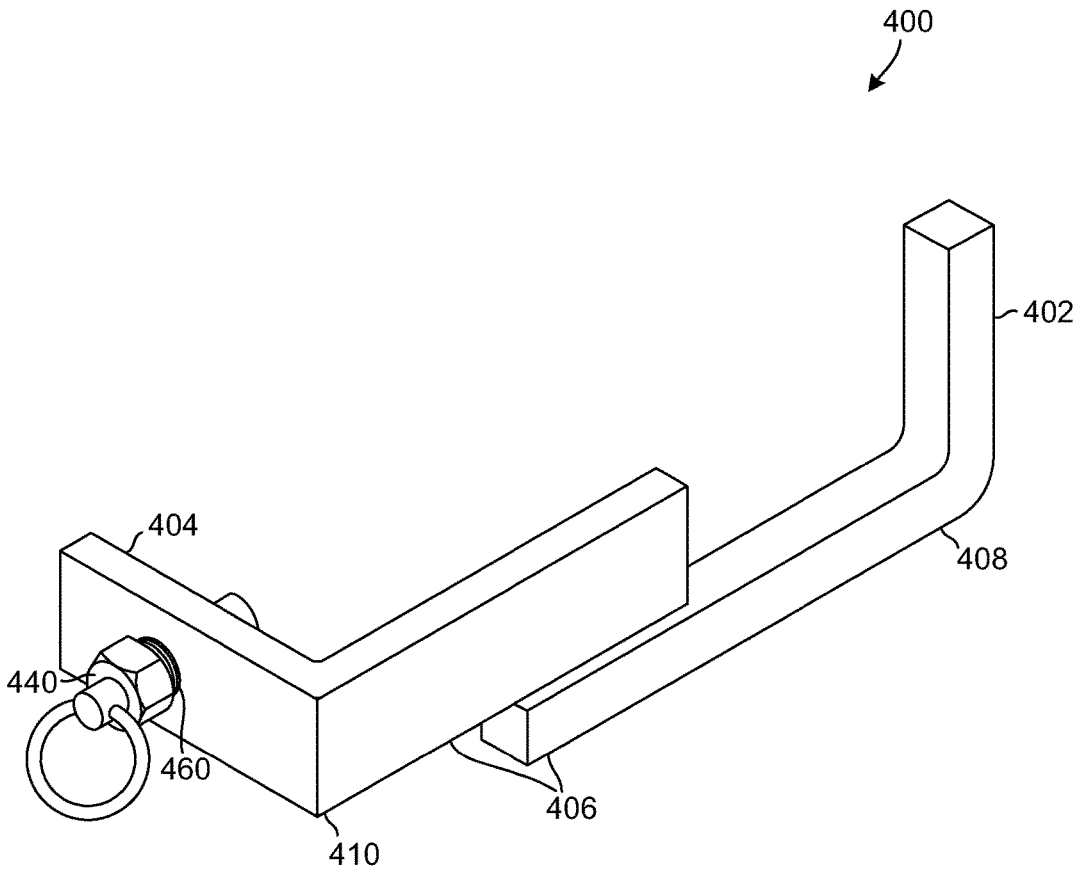
FIG. 5 illustrates an isometric view of another embodiment of a jamb lock door clamp.

FIG. 5 illustrates an embodiment of the jamb lock door clamp 400 in the form of a hooked bracket. The hooked bracket type door clamp 400 includes a door hook portion 402 that slips under a door 200 and is turned to be positioned adjacent the outer side 250 of the door 200. The hooked bracket type door clamp 400 illustrated in FIG. 5 also includes a frame hook portion 404 that is placed adjacent the door frame 220. The door hook portion 402 extends from a first end 408 of a central portion 406 and the frame hook portion 404 extends from an opposite second end 410 of the central portion 406 in the embodiment depicted in FIG. 5. A fastener 440, such as the holding pin 170 described herein, may be placed through an orifice 460 in the jamb lock door clamp 400. In the embodiment illustrated in FIG. 5, the orifice 460 is located in the frame hook portion 404 of the jamb lock door clamp 400 such that the fastener 440 can extend into the inner surface 238 of the door frame 220.

In other embodiments, the orifice 460 may be located in other than the frame hook portion 404, such as in a clamping bracket extension 405 extending from the jamb lock door clamp 400. The fastener 440 may be placed through the orifice 460 into the floor 219, the wall 221 adjacent the door frame 220, the fastener bracket 960, or another surface or apparatus into which the fastener 440 is desired to extend, examples of which may be seen in other embodiments contained herein. It should be noted that the frame hook portion 404 may not be necessary in certain embodiments where the door clamp 400 may, for example, be pinned, attached, or otherwise secured to the facing surface 236 of the door frame 220 or the floor 219 without turning along the inner surface 238 of the door frame 220. Thus, the orifice 460 may be located in the jamb lock door clamp 400 such that the fastener 440 extends into the inner surface 238 of the door frame 220 or elsewhere, as desired.

Figure 34:
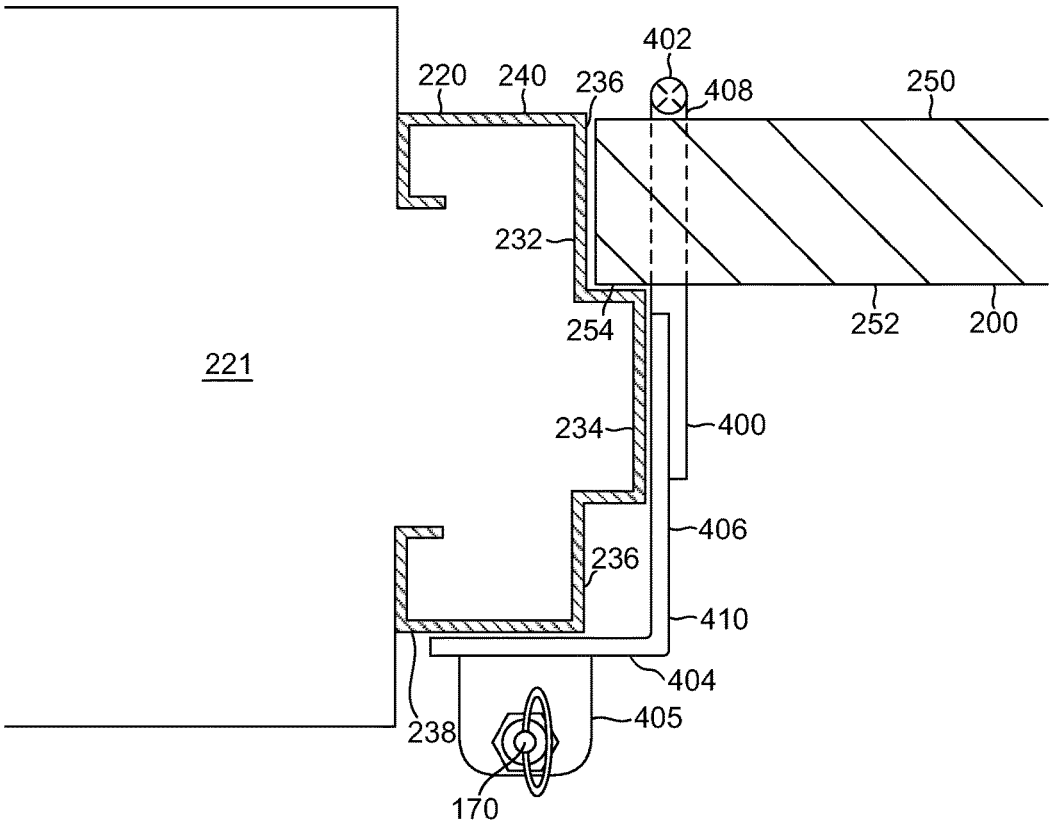
FIG. 34 illustrates a top view of an embodiment of a door clamp positioned adjacent a door and frame with a fastener that extends into a floor.
Figure 35:
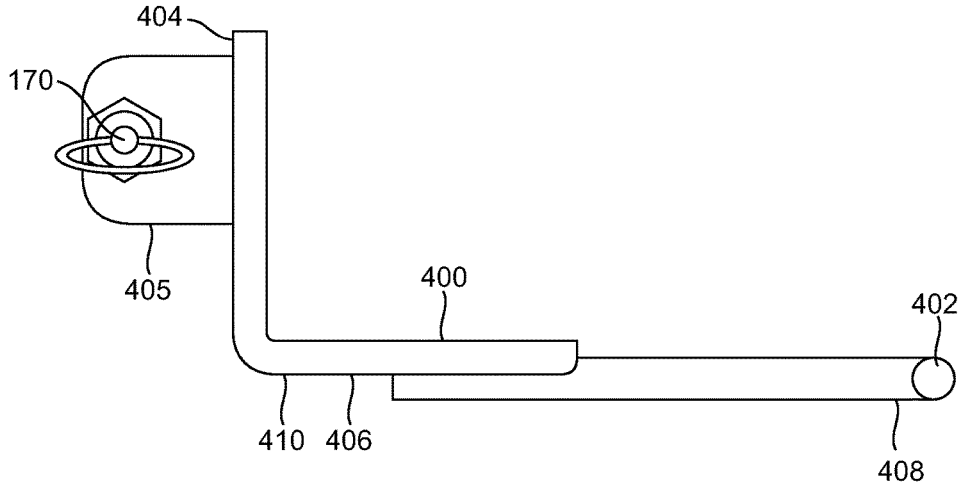
FIG. 35 illustrates a top view of the door clamp of FIG. 34.
Figure 36:
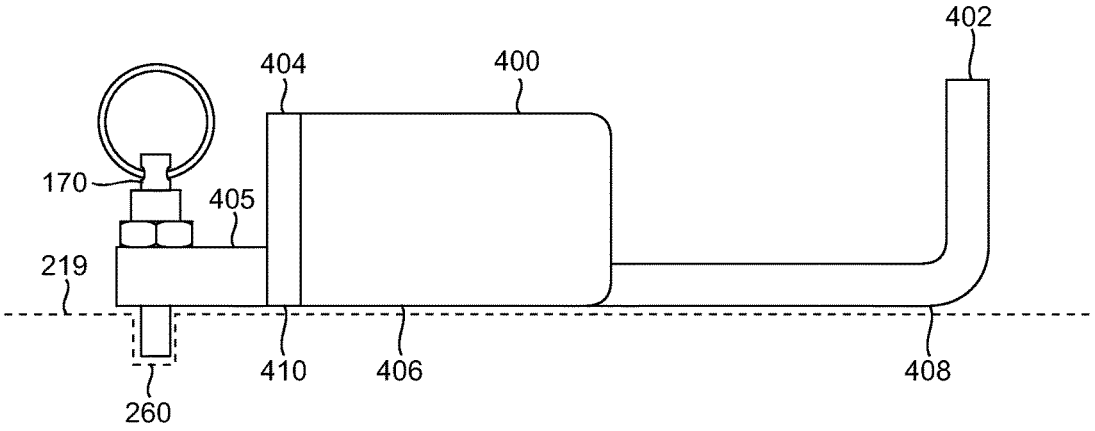
FIG. 36 illustrates a side view of the door clamp of FIGS. 34 and 35.

FIGS. 34, 35, and 36 illustrate an embodiment of the jamb lock door clamp 400 in the form of a hooked bracket with a holding pin 170 that extends through the door clamp 400 into an adjacent floor 219. The hooked bracket type door clamp 400 of that embodiment includes a door hook portion 402 that slips under a door 200 and is turned to be positioned adjacent the outer side 250 of the door 200. The hooked bracket type door clamp 400 illustrated in FIGS. 34-36 also includes a frame hook portion 404 that is placed adjacent the door frame 220. The door hook portion 402 extends from a first end 408 of a central portion 406 and the frame hook portion 404 extends from an opposite second end 410 of the central portion 406 in the embodiment depicted in FIGS. 34-36. A fastener 440, such as the holding pin 170 described hereinabove, may be placed through an orifice 460 in the jamb lock door clamp 400, which may be located as desired, for example vertically in the frame hook portion 404 of the door clamp 400 or an extension 405 of the door hook portion 404, as illustrated in FIGS. 34-36.

FIG. 34 illustrates the jamb lock door clamp 400 in use keeping the door 200 in its closed position. In that configuration, the door hook portion 402 extends along the outer surface 250 of the door 200, while the base 406 is attached to the door hook portion 402 at approximately a right angle and extends under the door 200. In the configuration illustrated in FIG. 34, the frame hook portion 404 is attached to the base 406 opposite the door hook portion 402 and extends along the inner surface 238 of the door frame 220. The clamping bracket extension 405 is attached to and extends from the frame hook portion 404 in this embodiment and a holding pin 170 extends through the clamping bracket extension 405 into a floor 219 adjacent the door and the door clamp 400.

It should be noted that the frame hook portion 404 illustrated in FIG. 34 is not necessary for the door clamp 400 to operate to keep the door 200 in its closed position. For example, the clamping bracket extension 405 may be attached directly to the base 406 with no portion of the door clamp 400 extending along the inner surface 238 of the door frame 220. In such an embodiment, the holding pin 170 may extend into the fastener orifice 260 (illustrated in FIG. 36, for example), thereby limiting the movement of the door 200 to a difference between an amount that the inner dimension of the fastener orifice 260 is larger than the outer dimension of the pin 170 and keeping the door 200 from being opened.

In an embodiment, the jamb lock door clamp 400 may not include a frame hook portion 404 and may be fastened directly to the floor 219 adjacent the door 200 by placing the holding pin 170 through an orifice 460 in the jamb lock door clamp 400 into the floor 219.

An embodiment of a method of installing the jamb lock door clamp 400 includes threading the hollow guide 300 depicted in FIG. 4 into the jamb lock door clamp 400. The jamb lock door clamp 400 is then positioned around the door 200 and against the door frame 220 as it is to be used. A fastener hole 260 is then created in the door frame 220, the floor 219, the wall 221 adjacent the door frame 220, the fastener bracket 960, or another surface or apparatus in which the fastener hole 260 has been formed so that, when the hollow guide 300 is replaced with the fastener 440, the fastener 440 can extend through the jamb lock door clamp 400 into a fastener hole 260, thereby securing the jamb lock door clamp 400 in its locking position.

Figure 6:
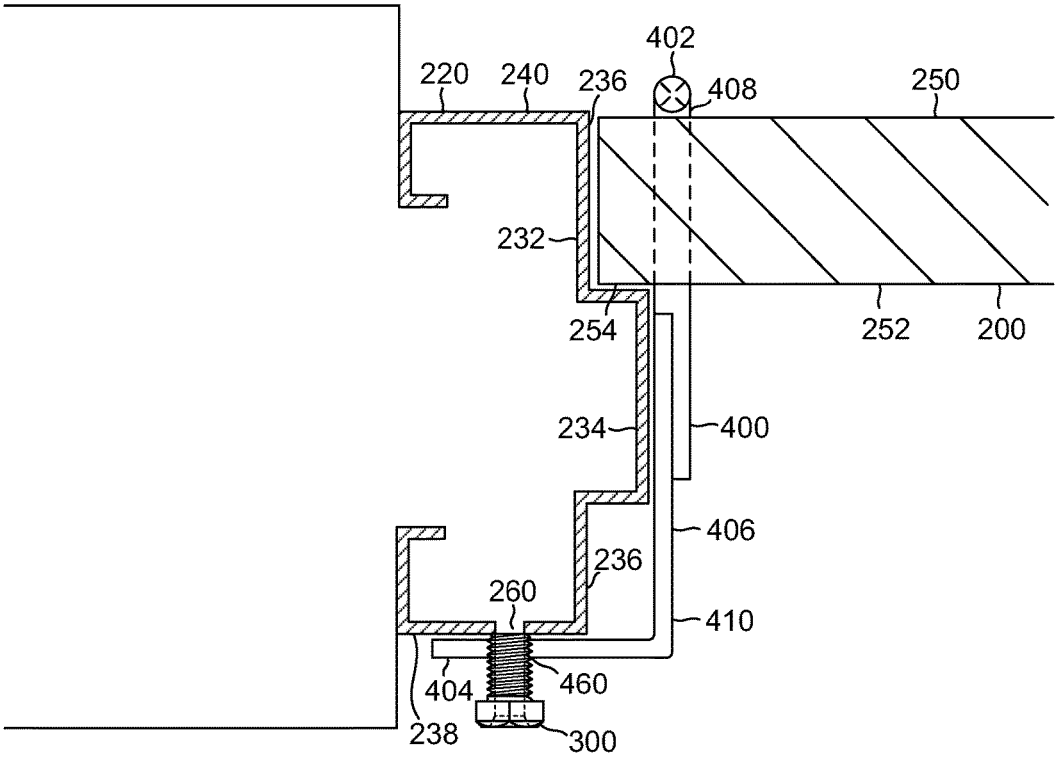
FIG. 6 illustrates a top view of the door clamp of FIG. 5 positioned adjacent the door and frame of FIG. 2 with the hollow guide of FIG. 4 positioned for forming a fastener hole.

FIG. 6 illustrates a top view of the door clamp 400 positioned adjacent a door 200 and frame 220 with the hollow guide 300 positioned for forming a fastener hole 260 in the door frame 220. As may be seen, the door clamp 400 is positioned adjacent the door frame 220 and the hollow guide 300 is threaded through the orifice 460 and tightened against the inner surface 238 of the door frame 220 to hold the door clamp 400 in place. The fastener hole 260 may then be formed through the hollow guide 300 by, for example, drilling through the hollow guide 300 into the door frame 220.

Figure 7:
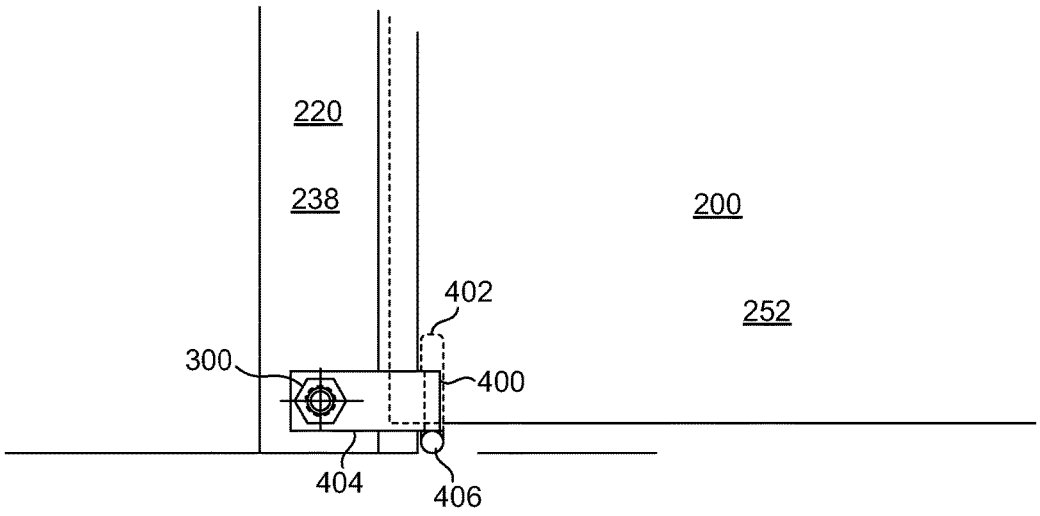
FIG. 7 illustrates a side view of a portion of the inner side of the door and frame of FIG. 2 with the door clamp of FIG. 5 and hollow guide of FIG. 4.

FIG. 7 illustrates a view of a portion of the inner side of the door 252 and frame 220 illustrated in FIG. 6. A jamb lock door clamp 400 is positioned adjacent the door 200 and frame 220 with the hollow guide 300 holding the door clamp 400 in place for drilling the fastener hole 260.

Figure 8:
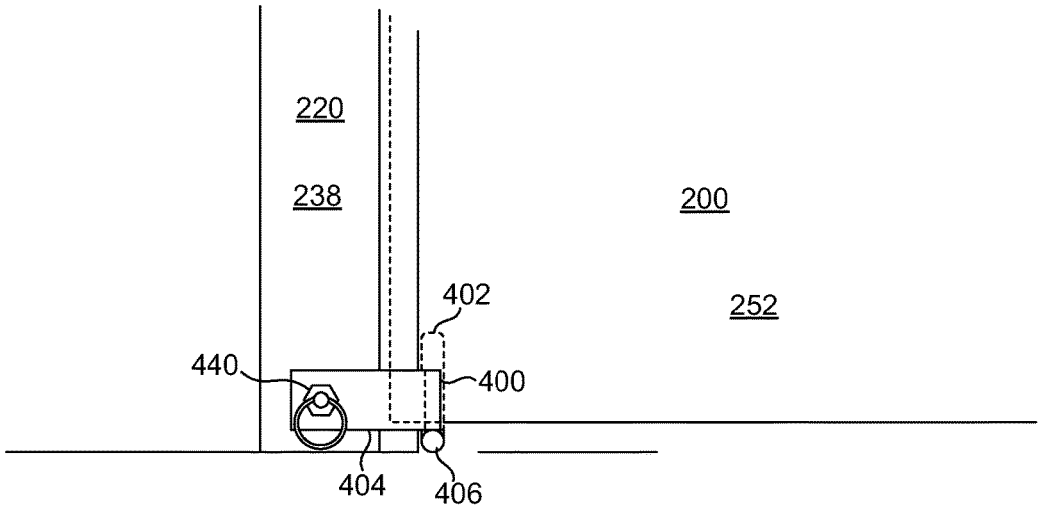
FIG. 8 illustrates the portion of the inner side of the door and frame of FIG. 7 with the door clamp of FIG. 5 and a holding pin threaded into the pin orifice of the door clamp.

FIG. 8 illustrates the portion of the inner side of the door 252 illustrated in FIG. 6 with the hollow guide 300 removed from the door clamp 400 and the fastener 440 threaded into the fastener orifice 160 of the door clamp 400 in place of the hollow guide 300. As may be seen in FIG. 8, the door hook portion 402 of the door clamp 400 is positioned adjacent the outer side 250 of the door 200 and the frame hook portion 404 is fastened to the door frame 220 by the fastener 440.

Whether including or not including the frame hook portion 404, the door clamp 400 can be attached to a door 200 and frame 220, floor 219, wall 221 adjacent the door frame 220, fastener bracket 960, or other surface or apparatus in which the fastener 440 is desired to extend by hand in seconds without tools or keys and is independent of a doorknob or handle assembly. The jamb lock door clamp 400 can furthermore be put in place and removed from inside a room without opening the door 200.

When operating the embodiment of the jamb lock door clamp 400 illustrated in FIG. 5, a user may rotate the jamb lock door clamp 400 such that the door hook portion 402 extends parallel to the floor and the perpendicular frame hook portion 404 extends upward from the floor. The jamb lock door clamp 400 may then be slid under the door 200 and rotated so that the door hook portion 402 extends up along the outer side 250 of the door 200 and the perpendicular frame hook portion 404 of the jamb lock door clamp 400 extends along the inner side 238 of the frame 220. The fastener 440 may then be placed through the jamb lock door clamp 400 or released if it is a biased fastener 440 attached to the jamb lock door clamp 400 such that the fastener 440 extends into the door frame 220, the floor 219, the wall 221 adjacent the door frame 220, the fastener bracket 960, or another surface or apparatus in which the fastener 440 is desired to extend.

The jamb lock door clamp 400, when placed in its locking position, thus extends under the door 200, clamping the outer side 250 of the door 200 against the door frame 220 floor 219, wall 221 adjacent the door frame 220, the fastener bracket 960, or another surface or apparatus inside the room. When positioned such, the jamb lock door clamp 400 secures a door 200 closed against the door frame 220, floor 219, wall 221 adjacent the door frame 220, the fastener bracket 960, or another surface or apparatus. When securing the door 200, the door hook portion 402 extends along the outer side 250 of the door 200, the central portion 400 extends under the door 200, the frame hook portion 404 extends along or into the door frame 220, for example, and the fastener 440 extends through the jamb lock door clamp 200 into the door frame 220, floor 219, wall 221 adjacent the door frame 220, fastener bracket 960, or another surface or apparatus.

Figure 9:
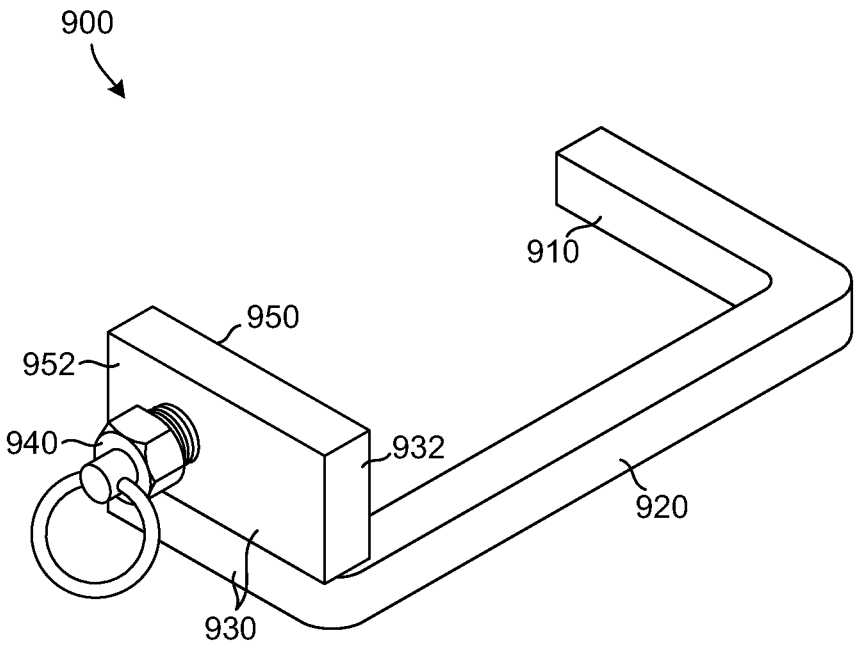
FIG. 9 illustrates an isometric view of an embodiment of a door clamping apparatus that may be used on a door that is to be prevented from swinging into a room.

FIG. 9 illustrates one embodiment of a door clamping apparatus 900 that may be used in an application where a door is to be prevented from swinging into a room. The door clamping apparatus 900 includes a jamb bracket 910, a base 920, a stop 930 having a stop extension, and a fastener 940. The door clamping apparatus 900 also has an inner side 950 and an outer side 952.

In operation, the jamb bracket 910 can extend along the door frame 220, into the door frame 220, for example below the door 200, or may be otherwise positioned so that the door 200 cannot swing in, but is stopped by the stop 930.

Figure 10:
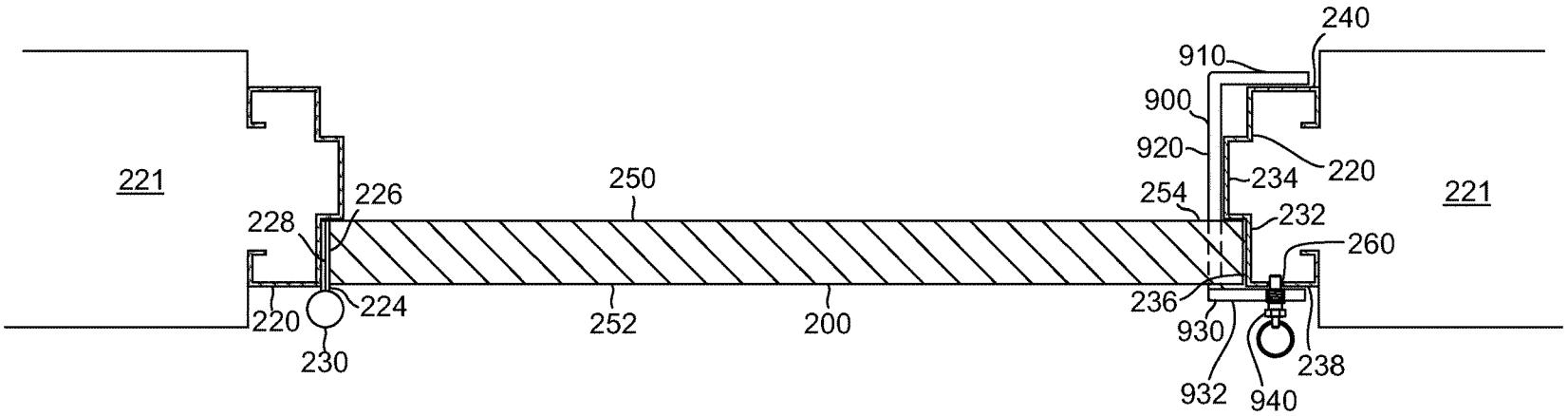
FIG. 10 illustrates a top view of the door clamping apparatus of FIG. 9 affixed to an inward swinging door.

FIG. 10 illustrates a top view of the door clamping apparatus 900 of FIG. 9 affixed to an inward swinging door 200. The door clamping apparatus 900 is affixed to the door 200 and frame 220, wherein the door 200 is attached to the frame 220 by hinges 224 having two halves, a door side hinge 226 and a frame side hinge 228, coupled by a hinge pin 230 such that the door side hinge 226 and the frame side hinge 228 rotate around the hinge pin 230, permitting the door 200 to swing open in a first direction and closed in a second, opposite direction.

The door 200 latches into a latch side jamb 232 portion of the frame 220. A strip 234 extends from the frame 220 or is formed in the frame 220 to stop the door 200 when the door 200 is closed. The door frame 220 further includes a facing surface 236 adjacent the door 200 when the door 200 is closed, an inner surface 238, and an outer surface 240.

The door 200 has an outer side 250 facing the direction in which the door swings closed and an inner side 252 facing the direction toward which the door 200 swings open. An edge 254 of the outer side 250 of the door 200 thus rests adjacent the strip 234 when the door is closed.

A fastener hole 260 may be created in the door frame 220, floor 219, wall 221 adjacent the door frame 220, fastener bracket 960, or another surface or apparatus for positive engagement of the door clamping apparatus 900 to the door frame 220, floor 219, wall 221 adjacent the door frame 220, fastener bracket 960, or another surface or apparatus. The fastener hole 260 in the door frame 220 may be created in various ways, as described herein.

The fastener 940 is optional and may extend through the stop 930 or stop extension 932 to secure the door clamping apparatus 900 to the door frame 220, door 200, floor 219, wall 221 adjacent the door frame 220, fastener bracket 960, or another surface or apparatus. Where the fastener hole 260 has been created, the fastener 940 may be inserted into the fastener hole 260 in any way desired, including placing a pin type fastener 940 through the stop 930 or stop extension 932 into the fastener hole 260 or by use of a holding pin 170, which engages the fastener hole 260 by releasing a spring-biased plunger 176, as described herein.

The stop 930 and jamb bracket 910 of this embodiment are arranged approximately in parallel and the stop 930 includes the stop extension 932, which extends up along the inner side 252 of the door 200 when the door clamping apparatus 900 is operably positioned under the door 200. Thus, when the stop 930 is placed along the outer surface 240 of the in-swinging door frame 220 with the base 920 extending under the door 220 and the stop extension 932 placed along the inner side 252 of the door 200, the door 200 is held adjacent the frame 220 by the door clamping apparatus 900 and thereby prevented from opening.

Figure 33:
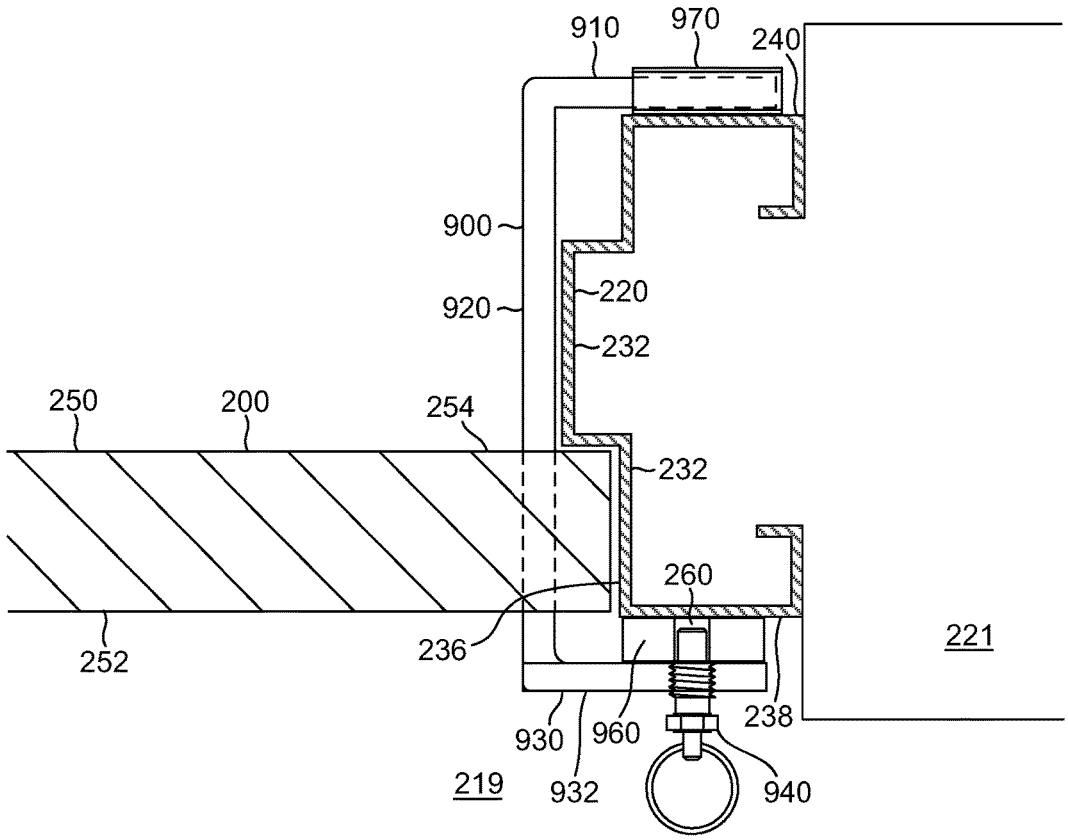
FIG. 33 illustrates a top view of an embodiment of a door clamping apparatus having a guard and a fastener bracket, affixed to an inward swinging door.
Figure 43:
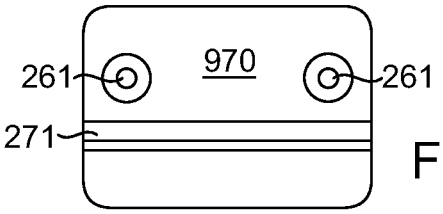
FIG. 43 illustrates a front view of an embodiment of a guard.
Figure 44:
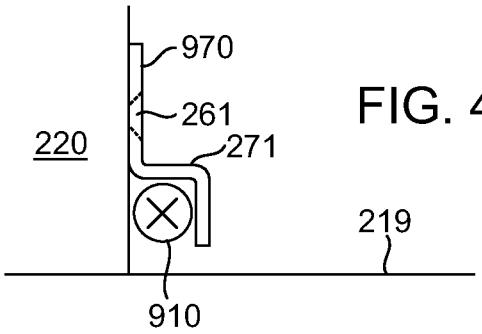
FIG. 44 illustrates a side view of the guard of FIG. 43 attached to a door frame and covering a portion of a door hook portion of a jamb lock door clamp.

FIGS. 43 and 44 illustrate a guard 970 that may be used to cover the jamb bracket 910 of the door clamping apparatus 900 as illustrated in FIG. 33 or another desired part of the door clamping device 900, or another door clamp 100 or 400, or other device described herein. The guard 970 illustrated in FIGS. 43 and 44 includes holes 261 for fastening the guard 970 to a door frame 220 as illustrated in FIG. 44, or other desired surface, using one or more screws or other desired fasteners. The guard includes a bent portion 271 that extends from the surface and thereby covers the jamb bracket 910 in the embodiment illustrated in FIG. 44.

An example of the use of the guard 970 is illustrated in FIG. 33 where the guard 970 is attached to the door frame 220 outer surface 240 and covers a jamb bracket 910 when the jamb bracket 910 is disposed in its door clamping position to hamper or reduce the likelihood or ease of tampering with the jamb bracket 910. Tampering with the jamb bracket 910 could occur, for example, when a potential intruder attempting to open the door 200 might kick or pry the jamb bracket 910 in an attempt to twist the door clamping apparatus e.g., 100, 400, 900 so that the jamb bracket 910 would slide under the door 200 thereby permitting the door 200 to be opened.

Figure 11:
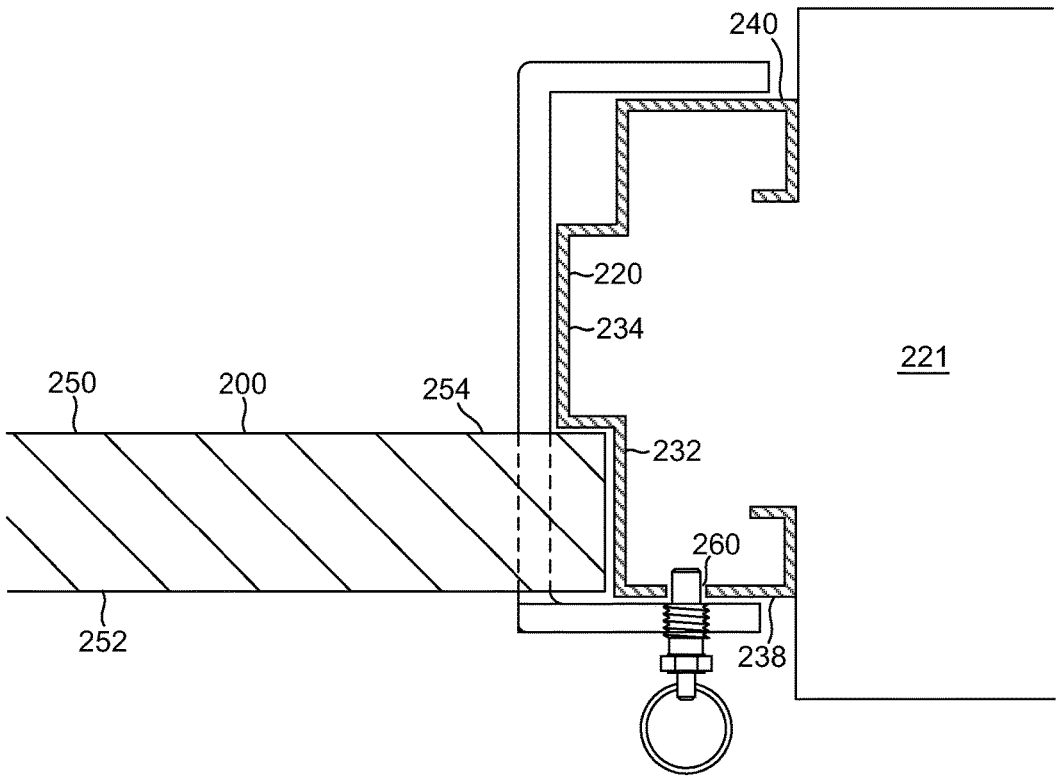
FIG. 11 illustrates an enlarged view of the door clamping apparatus of FIG. 9 affixed to the inward swinging door illustrated in FIG. 10.

FIG. 11 illustrates a partial view of the door clamping apparatus 900 illustrated in FIG. 9 holding an inward swinging door 200 against a door frame 220. In that embodiment, a plunger type fastener 940 is used to affix the door clamping apparatus 900 to the frame 220, though a fastener 940 of any type desired could be used and the fastener 940 could affix the door clamping apparatus 900 to the door 200, floor 219, wall 221 adjacent the door frame 220, fastener bracket 960, or another desired surface or apparatus.

When operating the embodiment of the door clamping apparatus 900 in an application where the door 200 is to be prevented from swinging into a room, a user may set the door clamping apparatus 900 on the floor such that the jamb bracket 910 is lying on the floor and the stop extension 932 extends upward from the floor. The door clamping apparatus 900 may then be slid under the door 200, jamb bracket 910 first, until the stop 930 or stop extension 932 is adjacent to the door 200. The base 920 may then be moved adjacent to or against the door frame 220. In that way, the base 920 may be adjacent or against the strip 234 of the inward swinging door frame, the jamb bracket 910 may be adjacent or against the outer surface 240 of the in-swinging door frame 220 or may extend into the door frame 220, for example below the door or elsewhere as desired, the stop 930 may be adjacent or against the inner surface 238 of the inward swinging door frame 220, and the stop extension 932 may be adjacent or against the inner side 252 of the door 200. The fastener 940 may then be placed through the door clamping apparatus 900 such that the fastener 940 extends into the door frame 220, for example passing through the inner surface 238 of the door frame 220 or may extend into the door 200, the floor 219, the wall 221 adjacent the door frame 220, a fastener bracket 960 or engaging apparatus, which may be attached to the door frame 220, the door 200, the floor 219, the wall 221 adjacent the door frame 220 or another surface or apparatus, as desired.

FIG. 11 illustrates an enlarged top view of a portion of the door 200 and frame 220 depicted in FIG. 10 with the door clamping apparatus 900 operably coupled to the door frame 220. As may be seen with reference to FIG. 11, when placed in its locking position, the door clamping apparatus 900 thus extends under the door 200, clamping the inner side 252 of the door 200 against the outer surface 240 of the door frame 220. When positioned such, the door clamping apparatus 900 secures the door 200 closed against the door frame 220. When securing the door 200 in this embodiment, the jamb bracket 910 extends along the outer surface 240 of the door frame 220, the base 920 extends under the door 200 along the door frame 220, possibly along the strip 234, the stop 930 extends along the facing surface 236 of the door frame 220, the jamb bracket extension 932 extends along the inner surface 252 of the door 200, and the fastener 440 extends through the door clamping apparatus 900, possibly the stop 930, into the door frame 220, possibly the inner surface 238 of the door frame 220.

FIG. 33 illustrates a view of an embodiment of the door clamping apparatus 900 wherein a fastener bracket 960 having a fastener hole 260, for engaging the fastener 940, is attached to the door frame 220 adjacent the inner side 252 of the door 200 and the guard 970 is attached to the door frame 220 adjacent the outer side 254 of the door 200. It should be noted that the fastener bracket 960 may be attached to the door 200, the floor 219, the wall 221 adjacent the door frame 220, or another area into which the fastener 940 is desired to extend or to which the fastener 940 is desired to engage. As may be seen with reference to FIG. 33, when placed in its locking position, the door clamping apparatus 900 of this embodiment extends under the door 200, clamping the inner side 252 of the door 200 against the outer surface 240 of the door frame 220 with the jamb bracket 910 protected from tampering by the guard 970 and the door clamping apparatus engaged to the fastener bracket 960 by having the fastener 140 extend into the fastener hole 260 of the fastener bracket 960. When positioned such, the door clamping apparatus 900 secures the door 200 closed against the door frame 220. When securing the door 200 in this embodiment, the jamb bracket 910 extends along the outer surface 240 of the door frame 220 and is protected by the guard 970, the base 920 extends under the door 200 along the door frame 220, possibly along the strip 234, the stop 930 extends along the facing surface 236 of the door frame 220, the jamb bracket extension 932 extends along the inner surface 252 of the door 200, and the fastener 440 extends through the door clamping apparatus 900 and into the fastener hole 260 in the fastener bracket 960, which is attached to the door frame 220 in this embodiment.

Figure 41:
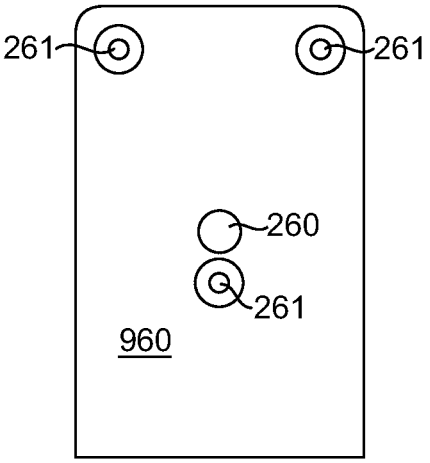
FIG. 41 illustrates a front view of an embodiment of a fastener bracket.
Figure 42:
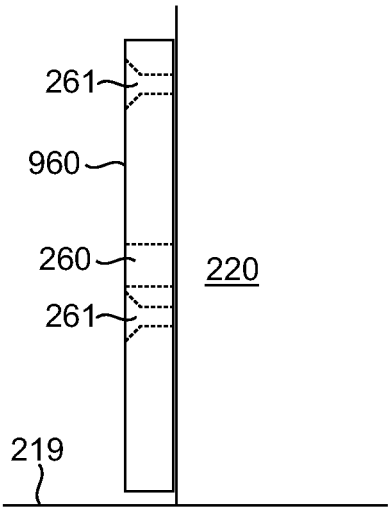
FIG. 42 illustrates a side view of the fastener bracket of FIG. 41.

FIGS. 41 and 42 illustrate an embodiment of the fastener bracket 960. In that embodiment, the fastener bracket includes a fastener hole 260 and three holes 261 for use to fasten the fastener bracket 960 to the door frame 220 or other desired surface by screws or otherwise as desired. FIG. 42 illustrates a side view of the fastener bracket 960 placed adjacent a door frame 220.

Figure 12:
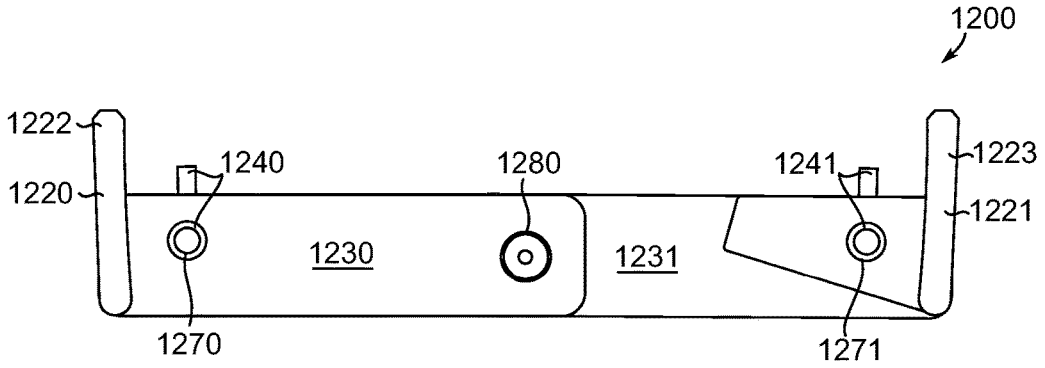
FIG. 12 illustrates a door side view of an embodiment of a door clamping device for use on single or double-doors.
Figure 15:
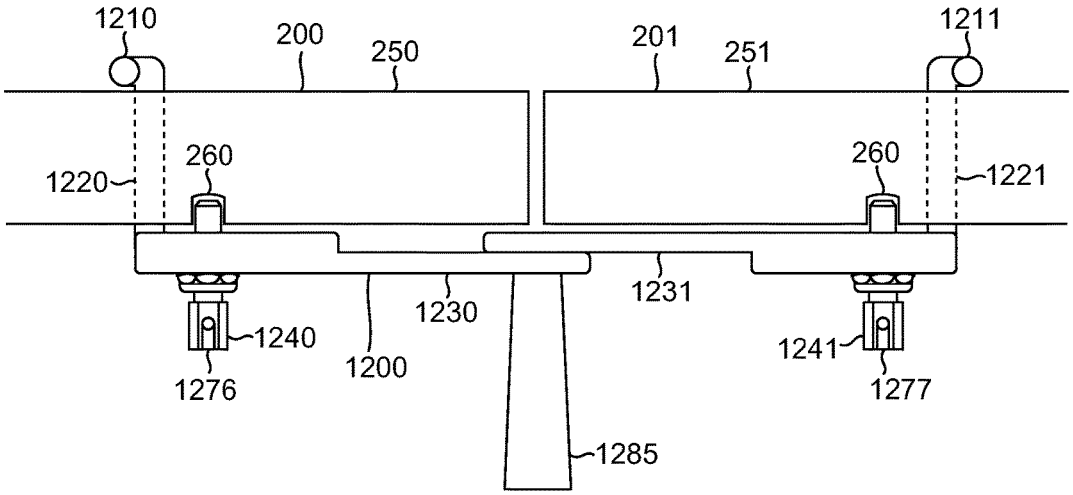
FIG. 15 depicts the door clamping device of FIGS. 12-14 affixed to double-doors.

FIG. 12 illustrates a door side view of an embodiment of a door clamping device 1200. The door clamping device 1200 can be for use on single-doors 200 as illustrated in FIGS. 37-40 or double-doors 200 and 201 as illustrated in FIG. 15.

The double-door clamping device 1200 includes a first stop 1210, a second stop 1211, a first base 1220 and a second base 1221, a first jamb bracket 1230 and a second jamb bracket 1231, a hinge 1280, a handle 1285, a first fastener 1240, and a second fastener 1241. The first and second bases 1220 and 1221 extend from the first and second jamb brackets 1230 and 1231 toward the viewer in FIG. 12. The first and second stops 1210 and 1211 turn up from the first and second bases 1220 and 1221, respectively, as viewed in FIG. 12. In that way the first and second jamb brackets 1230 and 1231 may be placed adjacent the door 200 or double-doors 200 and 201 on the side from which the door 200 or doors 200 and 201 are being secured, while the first and second stops 1210 and 1211 turn up along the side of the door 200 or double-doors 200 and 201 opposite the side from which the door 200 or doors 200 and 201 are being secured in use, as may be seen in FIG. 15.

Figure 13:
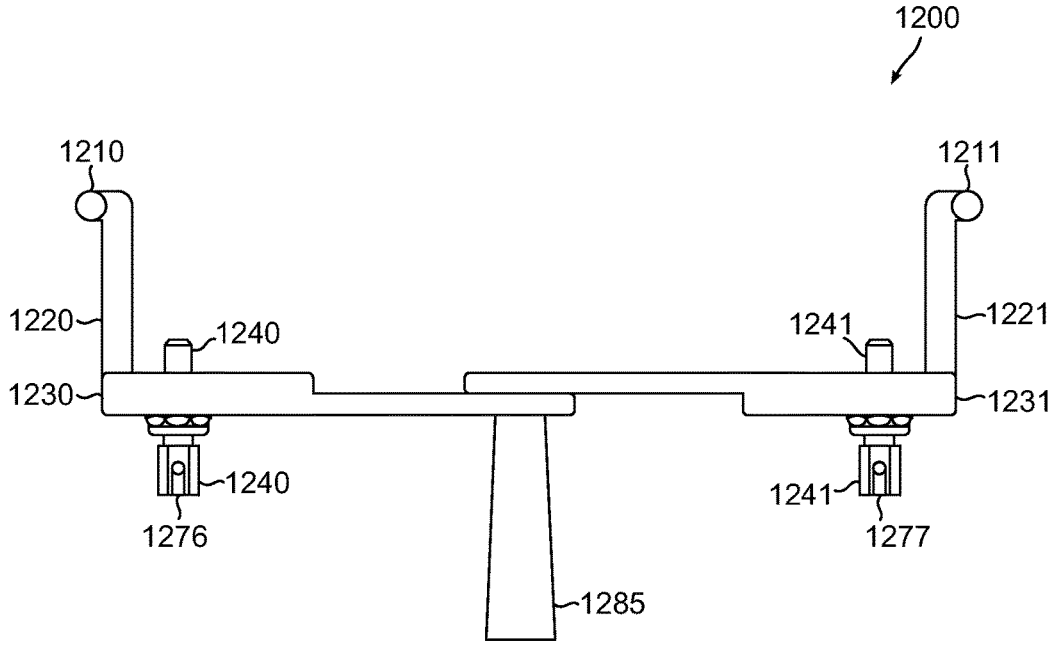
FIG. 13 illustrates a top view of the door clamping device of FIG. 12.

FIG. 13 illustrates a top view of the embodiment of the door clamping device 1200 illustrated in FIG. 12. As may be seen, the handle 1285 of this embodiment is concentric with the hinge 1280 such that when the handle 1285 is grasped and the door clamping device 1200 is lifted by the handle 1285 with the handle 1285 in a substantially horizontal orientation, the first and second jamb brackets 1230 and 1231 rotate about the hinge 1280 and the first and second bases 1220 and 1221 move toward one another, as is illustrated in FIG. 14.

FIG. 13 further illustrates that the first and second bases 1220 and 1221 extend from the first and second jamb brackets 1230 and 1231 and that the first and second stops 1210 and 1211 turn from the first and second bases 1220 and 1221 opposite from the first and second jamb brackets 1230 and 1231. FIG. 13 also illustrates fasteners or holding pins 1240 and 1241 in one embodiment in which the holding pins 1240 and 1241 include spring-biased plungers 1276 and 1277, respectively, (which may be similar to the spring-biased plunger 176 illustrated in FIG. 5) that have plungers that may be rotated when pulled to lock the plungers in an unextended position. The fasteners or holding pins 1240 and 1241 may alternately or in addition be positioned in the door clamping device 1200 so as to extend into a floor 219, a fastener engaging apparatus 960 or elsewhere as desired.

Figure 14:
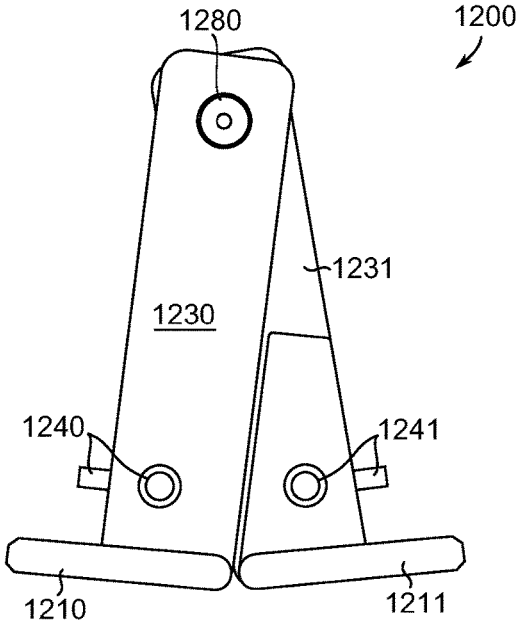
FIG. 14 illustrates a door side view of the door clamping device of FIGS. 12 and 13 in a folded configuration.

FIG. 14 illustrates the door clamping device 1200 in a folded configuration. As may be seen with reference to FIG. 13, the first jamb bracket 1230 and the second jamb bracket 1231 rotate about the hinge 1280 such that the first base 1220 and the second base 1221 are approximately aligned. In such a folded configuration, with the handle 1285 included in this embodiment held substantially horizontal and the first base 1220 and second base 1221 hanging so that they extend out from the first jamb bracket 1230 and the second jamb bracket 1231, respectively, parallel with the floor and the first stop 1210 and second stop 1211 extend perpendicular to the first jamb bracket 1230 and the second jamb bracket 1231, respectively, also parallel with the floor, the first stop 1210 and second stop 1211 and the first base 1220 and the second base 1221 may be slid under one or more doors 200 and 201 where applicable such that the first and second bases 1220 and 1221 extend under the door 200 (and 201 where applicable) and the first and second stops 1210 and 1211 are disposed beyond outer surfaces 250 (and 251 where applicable) of door 200 (and 201 where applicable). Where a handle 1285 is included and is attached to the door clamping device 1200 coaxially with the hinge 1280, the handle 1285 may then be lowered so that the first and second jamb brackets 1230 and 1231 rotate about the hinge 1280. When the handle 1285 is lowered and the first and second jamb brackets 1230 and 1231 rotate about the hinge 1280, the first and second bases 1220 and 1221 move apart, possibly sliding along the floor, and the first and second stops 1210 and 1211 extend up along the outer surfaces 250 or 251 of the door 200 or doors 200 and 201 and may extend substantially vertically, as is illustrated in FIG. 15. The first and second jamb brackets 1230 and 1231 may furthermore extend up along interior surface 252 or surfaces 252 and 253 of the door 200 or doors 200 and 201.

In other embodiments, a handle 1285 may not be included on the door clamping device 1200 or the handle 1285 may be attached to the door clamping device 1200 in a position other than the coaxial with the hinge 1280 position illustrated in FIGS. 12-15. For example, as may be seen in FIG. 38, in an embodiment where a handle 1285 is included on the door clamping device 1200, but is not attached to the door clamping device 1200 coaxial to the hinge 1280, the handle 1285 may be attached to one or both of the first and second jamb brackets 1230 and 1231. In such an embodiment, one or both handles 1285 may be used to move the door clamping device 1200 from a position in which the door clamping device 1200 is slid under a door 200 or 201, such as the positions illustrated in FIGS. 14 and 40, to a position in which the first and second stops 1210 and 1211 of the door clamping device 1200 extend up along the outer surfaces 250 and 251 of the door 200 or doors 200 and 201, such as the position illustrated in FIGS. 37-39.

In certain embodiments, more than one handle 1285 may be attached to the door clamping device 1200 in desired positions including, for example, one on each of the first and second jamb brackets 1230 or 1231 or on one or both jamb brackets 1230 or 1231 and coaxial with the hinge 1280.

As illustrated in FIGS. 13 and 14, the first jamb bracket 1230, the second jamb bracket 1231, or both jamb brackets 1230 and 1231 may be shaped such that the jamb brackets 1230 and 1231 engage one another when they rotate to the folded orientation illustrated in FIG. 14 or, alternately, the first and second bases 1220 and 1221 may come into contact with one another to terminate rotation into the folded orientation.

Set-up of the door clamping device 1200 may be performed by an installer standing on the side of the door 200 or double-doors 200 and 201 desired to be secured. When the door clamping device 1200 is configured as illustrated and described in connection with FIGS. 12-15, the installer may lift the door clamping device 1200 by the handle 1285, thereby permitting the first jamb bracket 1230 and the second jamb bracket 1231 to rotate about the hinge 1280 and hang downward in its folded orientation, as illustrated in FIG. 14. With the door clamping device 1200 in the folded orientation and the handle 1285 in hand, the first and second bases 1220 and 1221 of the door clamping device 1200 may be placed on the floor 219 at the base of the door 200 or doors 200 and 201 near the place where the door clamping device 1200 is to be situated. Next, the stop 1210 and the second stop 1211, as well as the first and second bases 1220 and 1221 may be slid through the space under the door 200 or doors 200 and 201 such that the first base 1220 and the second base 1221 are disposed under the door 200 or doors 200 and 201 and the first stop 1210 and the second stop 1211 extend beyond the outer surfaces 250 and 251 of the door 200 or double-doors 200 and 201. The door clamping device 1200 may be positioned such that its center is near the vertical line formed where the doors 200 and 201 meet in a double-door application. The door clamping device 1200 may be positioned such that it is toward the side of the door 200 that swings open in a single door 200 application. The installer can then push down on the handle 1285, thereby moving the handle toward the floor 219. The motion of moving the handle 1285 toward the floor 219 causes the first jamb bracket 1230 and the second jamb bracket 1231 to rotate about the hinge 1280 such that the first jamb bracket 1230 and the second jamb bracket 1231 extend out to opposite sides of the hinge 1280 along the floor 219 and the first stop 1210 and the second stop 1211 extend up along the outer surfaces 250 and 251 of the door 200 or double-doors 200 and 201 from the side of the double-doors 200 and 201 that is to be secured.

Figure 37:
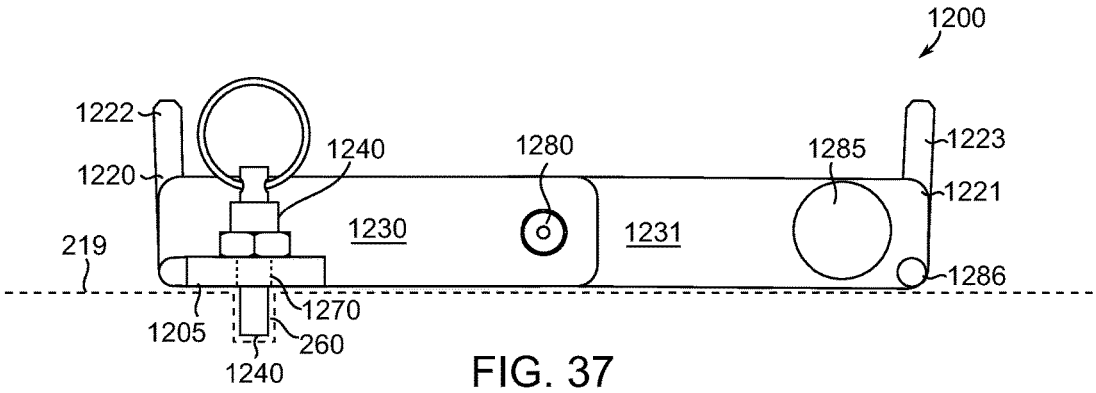
FIG. 37 illustrates a front view of a hinged door clamping device.
Figure 38:
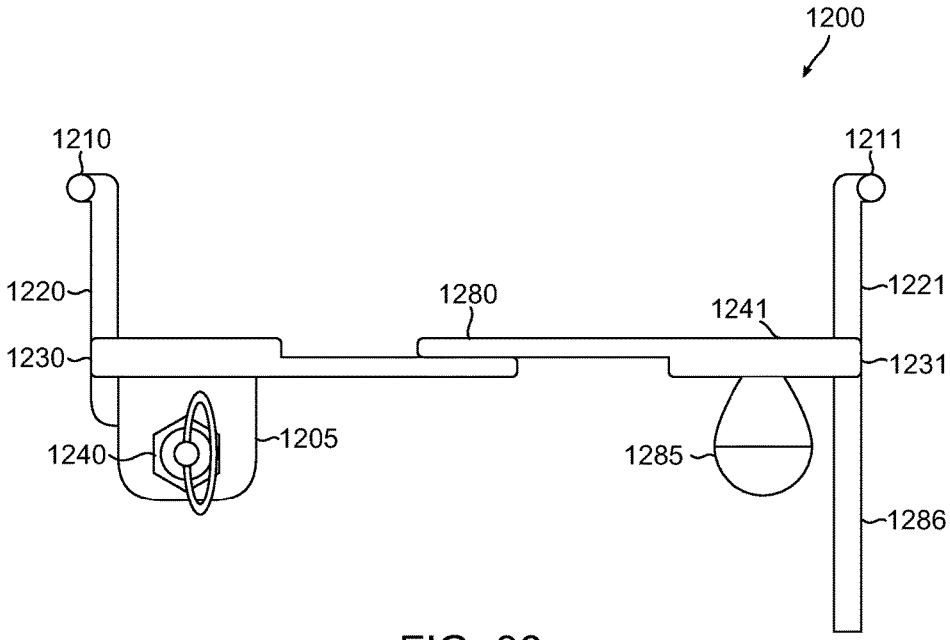
FIG. 38 illustrates a top view of the hinged door clamping device of FIG. 37.
Figure 39:
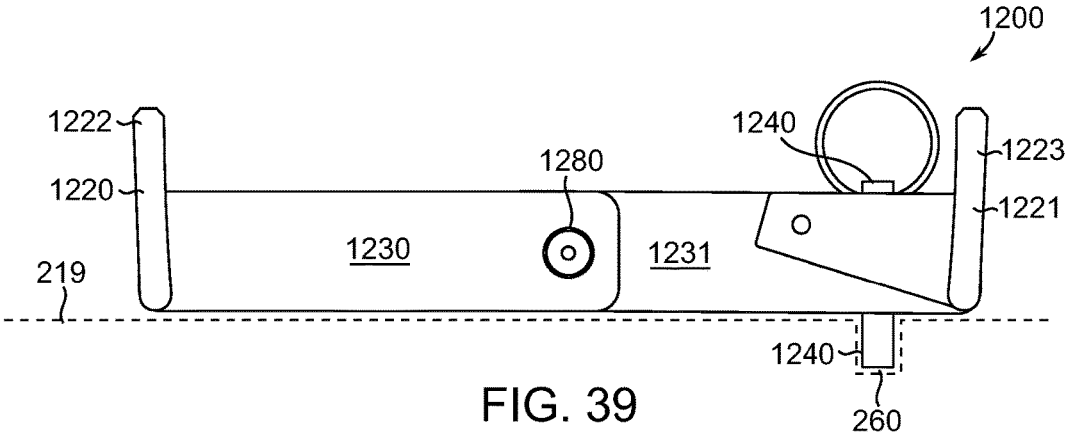
FIG. 39 illustrates a back view of the hinged door clamping device of FIGS. 37 and 38.
Figure 40:
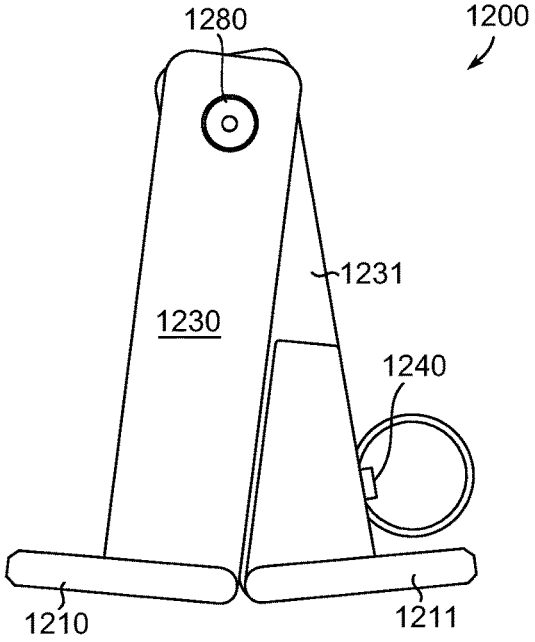
FIG. 40 illustrates a folded back view of the hinged door clamping device of FIGS. 37 through 39.

In certain embodiments, the door clamping device 1200 may have holding pins 1240 and 1241 for extending into the floor 219 below and adjacent to the door 200 or double-doors 200 and 201 such as, for example, is shown in FIGS. 37 and 39. In such an embodiment, set-up of the door clamping device 1200 may also be performed by an installer standing on the side of the door 200 or double-doors 200 and 201 desired to be secured. When the door clamping device 1200 is configured as illustrated and described in connection with FIGS. 12-15, the installer may move the door clamping device 1200 in the vicinity of the hinge 1280 upward, for example by lifting the door clamping device 1200 near the hinge 1280, thereby permitting the first jamb bracket 1230 and the second jamb bracket 1231 to rotate about the hinge 1280 and hang downward in its folded orientation. With the door clamping device 1200 in its folded orientation, the first and second bases 1220 and 1221 of the door clamping device 1200 may be placed on the floor 219 at the base of the door 200 or doors 200 and 201 near the place where the door clamping device 1200 is to be situated. Next, the stop 1210 and the second stop 1211, as well as the first and second bases 1220 and 1221 may be slid through the space under the door 200 or doors 200 and 201 such that the first base 1220 and the second base 1221 are disposed under the door 200 or doors 200 and 201 and the first stop 1210 and the second stop 1211 extend beyond the outer surface 250 of the door 200 or outer surfaces 250 and 251 of the double-doors 200 and 201. The door clamping device 1200 may be positioned such that its center is near the vertical line formed where the doors 200 and 201 meet in a double-door application. The door clamping device 1200 may be positioned such that it is toward the side of the door 200 that swings open in a single door 200 application or elsewhere along the width of the door 200 as desired. The installer can then permit the first jamb bracket 1230 and the second jamb bracket 1231 to rotate about the hinge 1280 into their extended position, such that the first jamb bracket 1230 and the second jamb bracket 1231 extend out to opposite sides of the hinge 1280 along the floor 219 and the first stop 1210 and the second stop 1211 extend up along the outer surfaces 250 and 251 of the door 200 or double-doors 200 and 201.

When the door clamping device 1200 is positioned in its door 200 (and 201 if appropriate) securing position, the installer may create one or more fastener holes 260 in the door 200, doors 200 and 201, floor 219, or other surface or apparatus, such as the fastener engaging apparatus 960 through one or more fastener orifices 1270 and 1271 so that, in actual use, the door clamping device 1200 may be secured to the door 200, doors 200 and 201, floor 219, or other surface or apparatus, such as the fastener engaging apparatus 960 by one or more holding pins 1240 and 1241 placed through the fastener orifices 1270 and 1271 into the fastener holes 260 created in the door 200, doors 200 and 201, floor 219 or another surface or apparatus, such as the fastener engaging apparatus 960. The fastener holes 260 in the doors 200 and 201 may be created in any way desired, including use of the hollow guide 300 as discussed herein.

After the fastener holes 260 have been created in the door 200, doors 200 and 201, floor 219, or other surface or apparatus, such as the fastener engaging apparatus 960, the one or more holding pins 1240 and 1241 may be placed in the fastener orifices 1270 and 1271 to ready the door clamping device 1200 for use.

Use of the door clamping device 1200 to secure one or more doors 200 and 201 is much as described in connection with set-up of the double-door clamping device 1200, with the exception that the one or more holding pins 1240 and 1241 are placed in the previously created one or more fastener holes 260 in the door 200, doors 200 and 201, floor 219, or other surface or apparatus, such as the fastener engaging apparatus 960 when the door clamping device 1200 is positioned with the fastener orifices 1270 and 1271 aligned with the fastener holes 260.

The holding pins 1240 and 1241 may be any type of pin desired including those employing a spring-biased plunger or any other type discussed herein or available. The spring-biased plunger type pins may be advantageous in that they can spring into the fastener holes 260 when the door clamping device 1200 is properly aligned, thereby simplifying installation in what might be a tense circumstance. Thus, installation of the door clamping device 1200 may be completed by holding the door clamping device 1200 in its folded configuration or orientation, which may be performed by holding the door clamping device 1200 by the handle 1285 when a handle 1285 is included on the door clamping device 1200 coaxial with the hinge 1280, such that the first base 1220 and a second base 1221 hang downward; sliding the first base 1220 and the second base 1221, as well as the first stop 1210 and the second stop 1211 under the door 200 or double-doors 200 and 201; and then spreading the first base 1220 and second base 1221 so that they rotate around the hinge 1280 to rest on the floor 219 with the first stop 1210 and second stop 1211 disposed substantially vertically along the outer surface 250 or surfaces 250 and 251 of the door 200 or double-doors 200 and 201, and sliding the door clamping device 1200 adjacent the interior surface 252 or surfaces 252 and 253 of the door 200 or double-doors 200 and 201 until the one or more retractable plunger pins 1240 and 1241 are released into the fastener holes 260.

To remove the door clamping device 1200, the one or more holding pins 1240 and 1241 can be removed from the one or more fastener holes 260 from the secured side of the door 200 or doors 200 and 201. Where one or more spring-biased retractable plunger pins 1240 and 1241 are used, the holding pins 1240 and 1241 may be removed from the fastener holes 260 by pulling the fastener pins 1240 and 1241 against the spring bias. In an embodiment, spring-biased retractable plunger pins 1240 and 1241 are rotatable and lock into a retracted position when rotated to a first position, while springing out when rotated into a second position. Thus, the rotatable and lockable fastener pins 1240 and 1241 may be retracted and locked for removal of the door clamping device 1200 and may be left in the retracted and locked position until the door clamping device 1200 is next placed on the door 200 or double-doors 200 and 201 for securing the door 200 or double-doors 200 and 201.

Once the one or more holding pins 1240 and 1241 have been removed from the door fastener holes 260, the user may lift the handle 1285 where the handle 1285 is included and is coaxial with the hinge 1280 or otherwise position the door clamping device 1200 in its folded orientation, such that the first jamb bracket 1230 and the second jamb bracket 1231 are rotated about the hinge 1280 and hang down such that the first base 1220 and the second base 1221 are approximately aligned. The first base 1220, the second base 1221 the first stop 1210, and the second stop 1211 may then be moved out from under the door 200 or double-doors 200 and 201. Such a door clamping device 1200 may be useful where, for example, the door 200 or double-doors 200 and 201 do not include panic hardware rods that extend from the door or double-doors 200 and 201 into the floor from the secured side of the door 200 or double-door 200 and 201.

Figure 45:
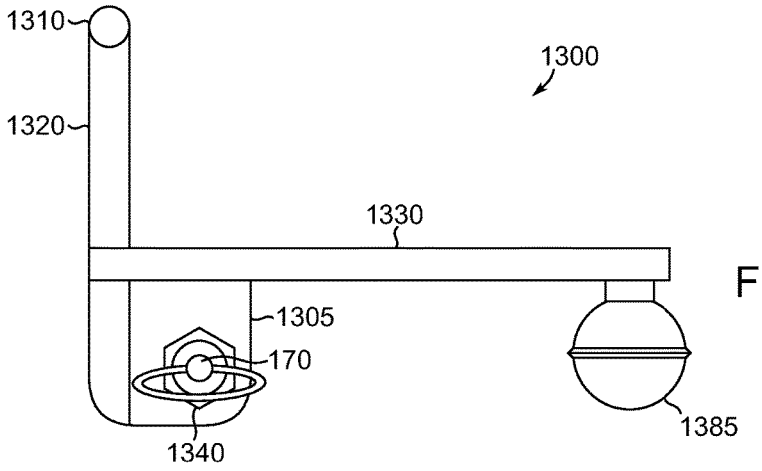
FIG. 45 illustrates a top view of an embodiment of a floor secured door clamp.
Figure 46:
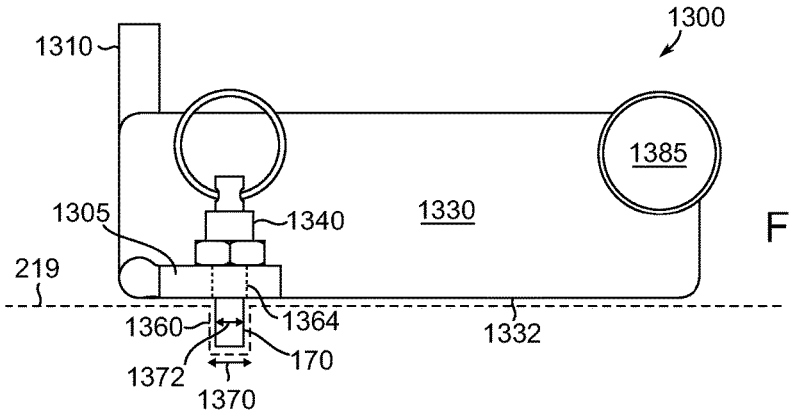
FIG. 46 illustrates a side view of the embodiment of the floor secured door clamp of FIG. 45.

FIG. 45 illustrates a top view of an embodiment of a floor secured door clamp 1300. The floor secured door clamp 1300 includes a stop 1310, a base 1320, a door bracket 1330, a door bracket extension 1305, a fastener 1360, and a handle 1385. FIG. 46 illustrates a side view of the embodiment of the floor secured door clamp 1300 of FIG. 45.

The stop 1310 of the floor secured door clamp 1300 of FIGS. 45 and 46 is attached to the base 1320. That stop 1310 has a first end and a second end and the first end is attached to a first end of the base 1320. The base 1320 in the embodiment illustrated in FIGS. 45 and 46 also has a second end and the second end of the base 1320 is attached to the door bracket 1330. A door bracket extension 1305 extends from the door bracket 1330 of that embodiment and the door bracket extension includes a fastener hole 1364 through which the fastener 1360 extends. Thus, in that embodiment, the fastener 1360 may further extend through the floor secured door clamp 1300 into a floor 219 or other desired surface or apparatus when installed.

A method of keeping a door 200 closed, includes positioning a stop 1310 portion of a door clamp 1300 horizontally, the door clamp 1300 having a base 1320 attached to a fastener extension 1330 and the stop 1310. Then the stop 1310 portion of the door clamp 1300 may be slid under the closed door 200 and past an outer side 250 of the closed door 200 with the base 1320 at least partially under the door 200. The door clamp 1300 may then be rotated such that the stop 1310 is vertical. Then, the door clamp 1300 may be moved until the pin 170 extends through the door clamp 1300 into a fastener orifice 1360 in a floor 219 adjacent the door clamp 1300, thereby maintaining the door 200 closed by a limitation of movement of the pin 170 in the fastener orifice 1360. In that method, the door 200 may be kept closed because the motion of the pin 170 in the fastener orifice 1360 is limited to an amount the diameter 1370 of the fastener orifice 1360 is larger than the diameter 1372 of the pin 170.

Figure 47:
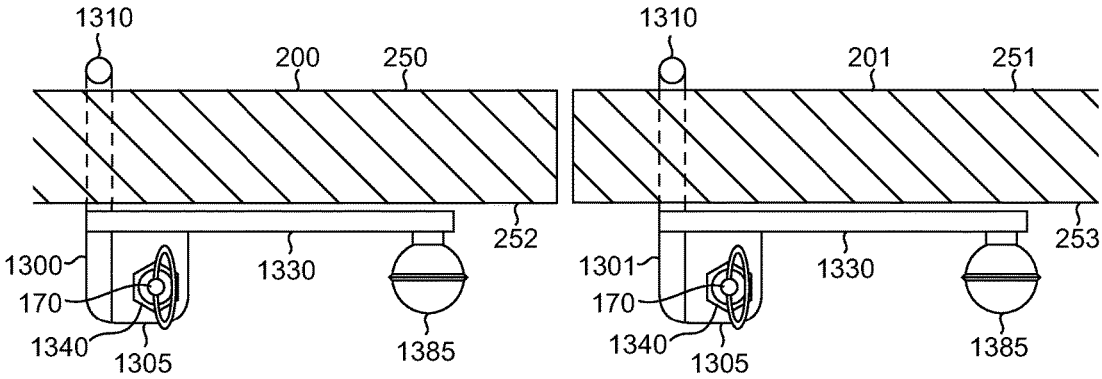
FIG. 47 illustrates two of the floor secured door clamps illustrated in FIGS. 45 and 46 used on double-doors.

FIG. 47 illustrates an embodiment in which two floor secured door clamps 1300 and 1301 are used on double-doors. The two floor secured door clamps 1300 and 1301 illustrated in FIG. 47 are similar in orientation, which may simplify their installation since, for example, they may be interchangeable. Alternately, the first floor secured door clamp 1300 may be a mirror image of the second floor secured door clamp 1301 or may be otherwise oriented as desired, for example, to expedite installation of the first and second floor secured door clamps 1300 and 1301.

In the embodiment illustrated in FIG. 47, the first floor secured door clamp 1300 is securing a first door 200 in a set of double-doors and the second floor secured door clamp 1301 is securing a second door 201 in the set of double-doors. In that way, each door 200 and 201 in the set of double-doors is secured to the floor.

As may be seen in FIG. 47, the stop 1310 is situated adjacent the outer side 250 of the door 200 and the door bracket 1330 is situated adjacent the inner side 242 of the door 200. The fastener 1340 extends through the floor secured door stop 1300, the door bracket extension 1305 portion of the floor secured door stop 1300 in the embodiment shown, and into the floor 219 beneath and adjacent the door 200. In that way, the door 200 is held securely between the stop 1310 and the door bracket 1330 and the floor secured door clamp 1300 is held in place by the fastener 1340, which extends into a fastener hole 1360 in the floor 219, thereby holding the door in its closed position.

In operation, the floor secured door stop 1300 may be rotated such that the stop 1310 is approximately horizontal and the stop 1310 may be moved under the door to be secured until the door bracket 1330 is against or adjacent the inner side 252 of the door 200. The floor secured door stop 1300 may then be rotated so that the stop 1310 extends up along or adjacent the outer side 250 of the door 200. The holding pin or fastener 1340 may then be placed in the fastener hole 1360 to prevent the door 200 from moving. One way of placing the holding pin or fastener 1340 in the fastener hole 1360 is to move the floor secured door stop along the floor until the holding pin of fastener 1340 falls into a preformed fastener hole 1360 under its own weight. Alternately or in addition, the holding pin or fastener 1360 may be depressed into the fastener hole 1360, for example, to assure it is well engaged with the floor 219.

The floor secured door stop 1300 may be configured such that the stop 1310 extends up along or adjacent the outer side 250 of the door 200 when a base surface 1332 of the door bracket 1330 is on the floor 219 or the fastener 1340, which may be configured parallel to the stop 1310, is perpendicular to the floor 219.

Rotation of the floor secured door stop 1300 may be aided by use of a handle 1385. For example, the handle may be held such that the floor secured door stop 1300 hangs from the handle with the stop in a substantially horizontal orientation. The stop 1310 may then be placed on or near the floor 219 and moved under the door until the door bracket 1330 is on or near the door 200. The handle 1385 may then be moved aside and downward in what may be a circular motion, thereby causing the stop 1310 to rotate up along the outer side 252 of the door 200 and the base surface to rest on the floor 219. The floor secured door stop 1300 may then be moved until the holding pin or fastener 1340, such as the holding pin 170 described herein, falls or is actuated into a fastener hole 1360 in the floor 219. In such a position, the stop 1310 is positioned along or adjacent the outer side 250 of the door 200, the door bracket 1330 is positioned along or adjacent the inner side 252 of the door 200 and the fastener 1340 is positioned in the fastener hole 1360, thereby preventing the door 200 from being moved in one or both directions, since the door 200 is disposed between the stop 1310 and the door bracket 1330 of the floor secured door clamp 1300 and the floor secured door clamp 1300 is prevented from moving by the fastener 1340 extending through the floor secured door clamp 1300 into the floor 219.

Where a single door is desired to be secured, one floor secured door clamp 1300, either as shown in FIGS. 45-47 or a mirror image or otherwise oriented floor secured door clamp 1300 may be used to secure that single door in a way that is similar to what is described herein for securing one of a set of double-doors.

In other embodiments, a method of keeping a door 200 closed includes positioning a stop 1310 portion of a door clamp 1300 horizontally, the door clamp 1300 having a base 1320 attached to a fastener extension 1330 and the stop 1310, sliding the stop 1310 portion of the door clamp 1300 under the closed door 200 and past an outer side 250 of the closed door 200, rotating the door clamp 1300 such that the stop 1310 portion is vertical, moving the door clamp 1300 toward a door frame 220 such that the base 1320 is positioned at least partially under the door 200 and the fastener extension 1330 is positioned on an inner side of the door, and placing a pin 170 extending through the door clamp 1300 into a fastener orifice 1360, thereby maintaining the door 200 closed by a limitation of movement of the pin 170 in the fastener orifice 1360. In that method, the fastener orifice 1360 may be a hole in a floor 219 adjacent the door 200, the pin 170 may extend into the fastener orifice 1360 in the floor 219, and the door 200 may be kept closed because the motion of the pin 170 in the fastener orifice 1360 is limited to an amount the fastener orifice 1360 is larger than the pin 170. Alternately, in that method, the fastener orifice 1360 may be a hole in a wall 221 adjacent a frame 220 of the door 200, the pin 170 may extend into the fastener orifice 1360 in the wall 221, and the door 200 may be kept closed because the motion of the pin 170 in the fastener orifice 1360 is limited to an amount the fastener orifice 1360 is larger than the pin 170. Also, in that method, the fastener orifice 1360 may be a hole in a fastener extension 1330, the pin 170 may extend into the fastener orifice 1360 in the fastener extension 1330, and the door 200 may be kept closed because the motion of the pin 170 in the fastener orifice 1360 is limited to an amount the fastener orifice 1360 is larger than the pin 170. In such embodiments, the fastener extension 1330 may be attached to a frame 220 of the door 200 or the wall 221 adjacent the door frame 220 and the door frame 220 may be the latch side jamb 232 portion of the frame 200 against which the door 200 closes. Alternately, the fastener extension 1330 may be attached to a floor 219 adjacent the door 200.

In various embodiments, the fastener bracket 960 may be attached to the door frame 220, wall 221, floor 219, or otherwise to provide a fastener orifice 1360 for the pin 170.

Figure 16:
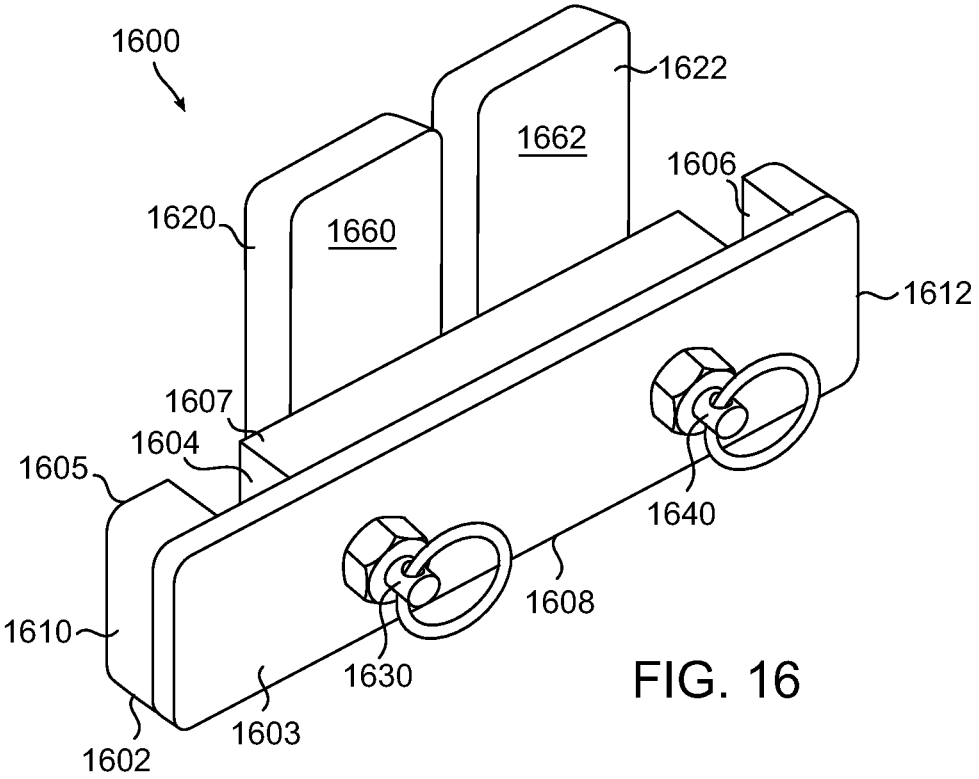
FIG. 16 illustrates an isometric view of an embodiment of a door clamp in an unsecured deployment.
Figure 17:
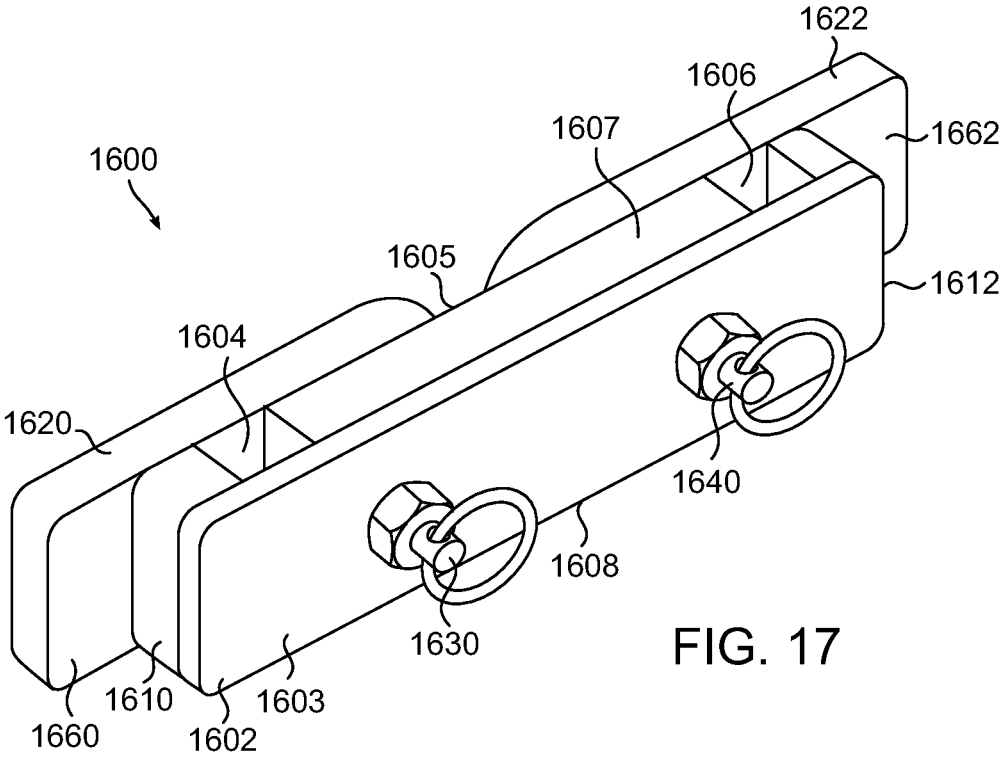
FIG. 17 illustrates an isometric view of the embodiment of the door clamp shown in FIG. 16 in a secured deployment.
Figure 18:
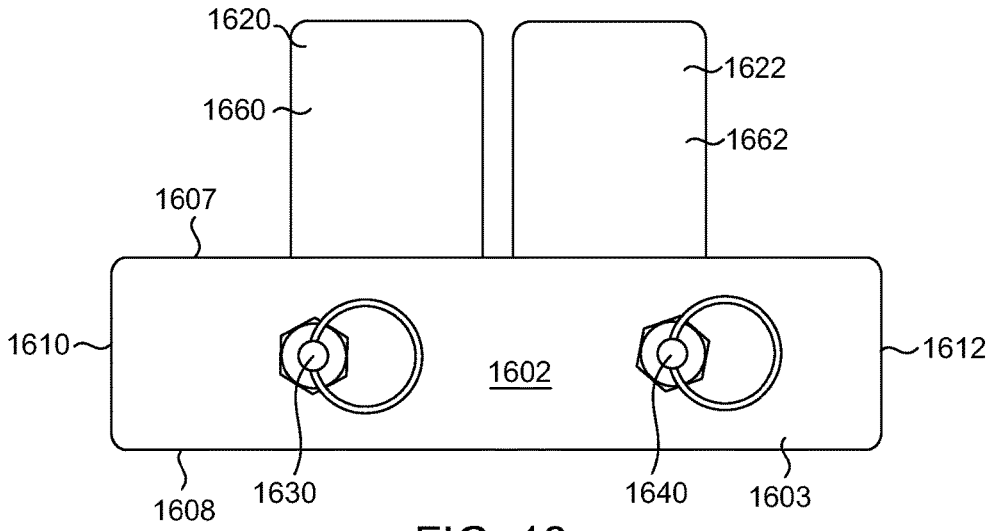
FIG. 18 illustrates an actuation side view of an embodiment of a door clamp in an unsecured deployment.
Figure 19:
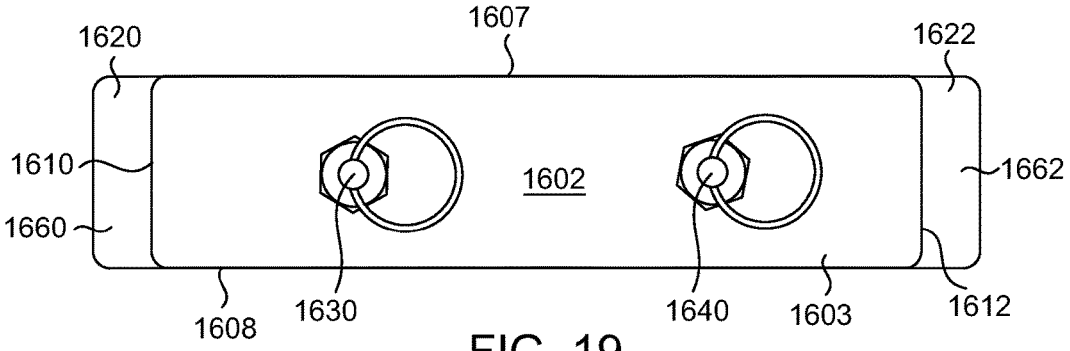
FIG. 19 illustrates an actuation side view of the embodiment of the door clamp shown in FIG. 18 in a secured deployment.
Figure 20:
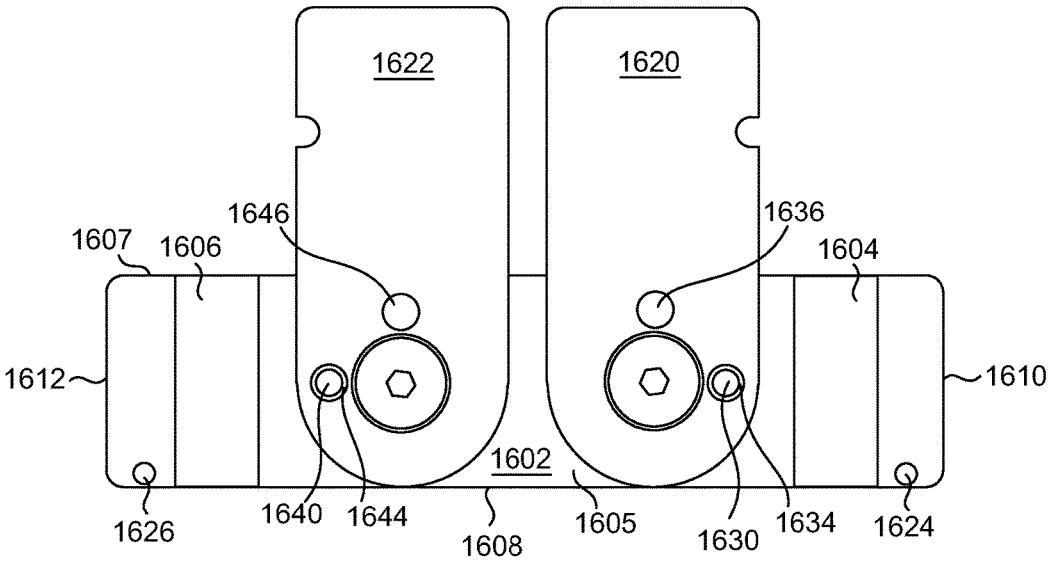
FIG. 20 illustrates a stop side view of an embodiment of a door clamp in an unsecured deployment.
Figure 21:
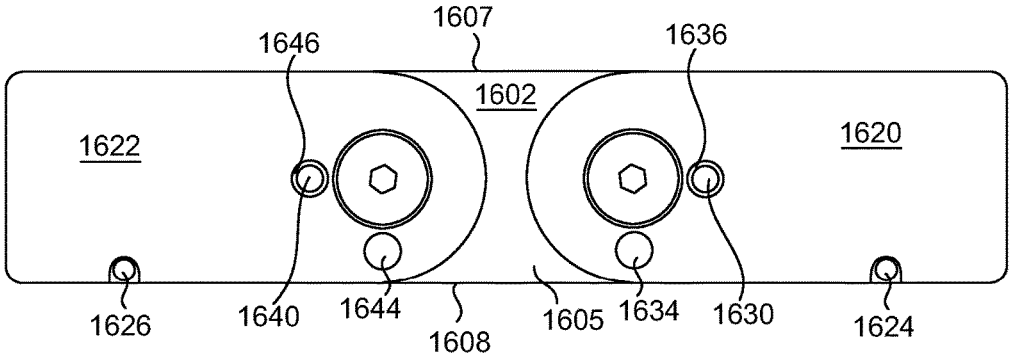
FIG. 21 illustrates a stop side view of the embodiment of the door clamp shown in FIG. 20 in a secured deployment.
Figure 23:
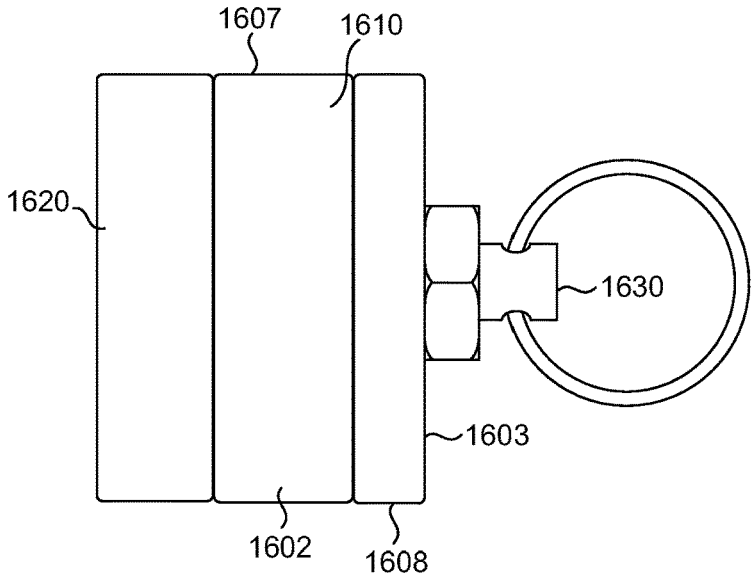
FIG. 23 illustrates a side view of the embodiment of the door clamp shown in FIG. 22 in a secured deployment.
Figure 24:
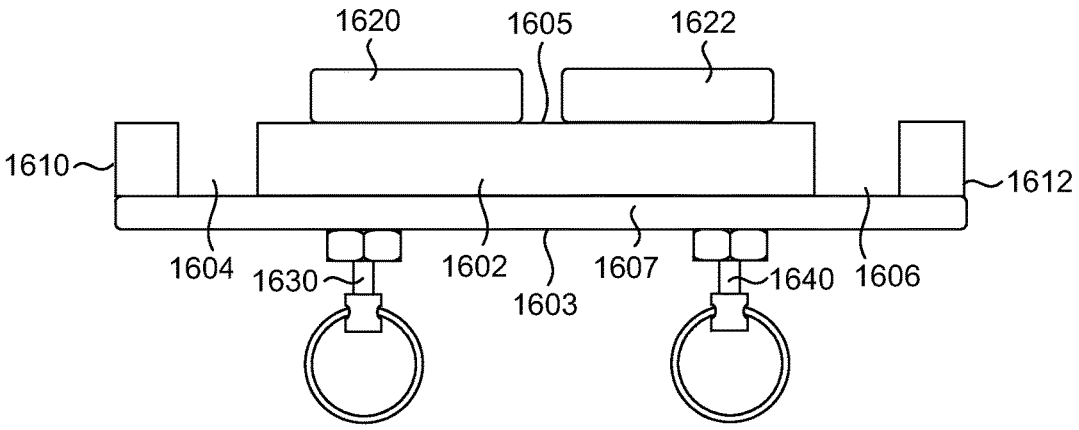
FIG. 24 illustrates a top view of an embodiment of a door clamp in an unsecured deployment.
Figure 25:
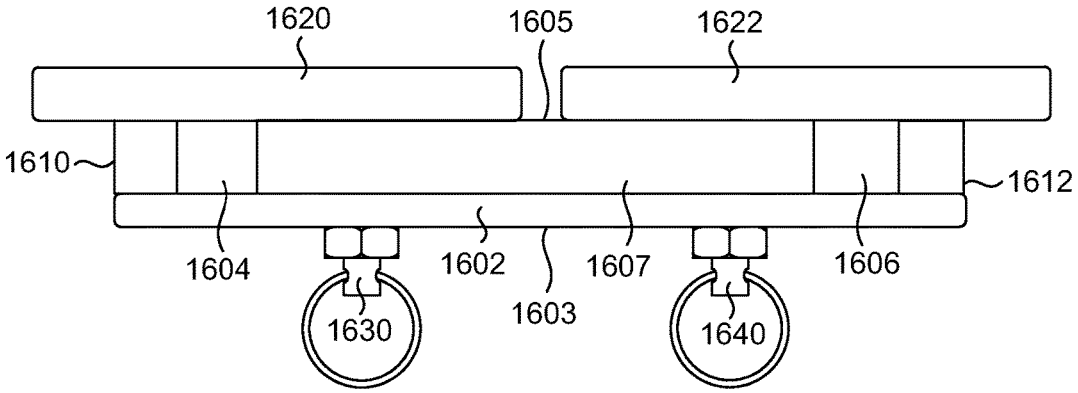
FIG. 25 illustrates a top view of the embodiment of the door clamp shown in FIG. 24 in a secured deployment.
Figure 26:
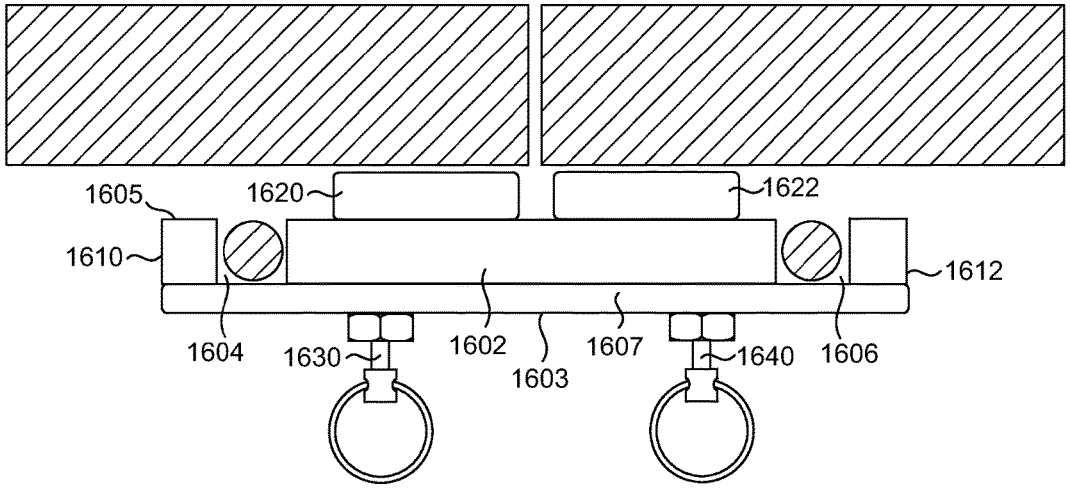
FIG. 26 illustrates a top view of an embodiment of a door clamp adjacent a double-door having vertical bars in an unsecured deployment.
Figure 27:
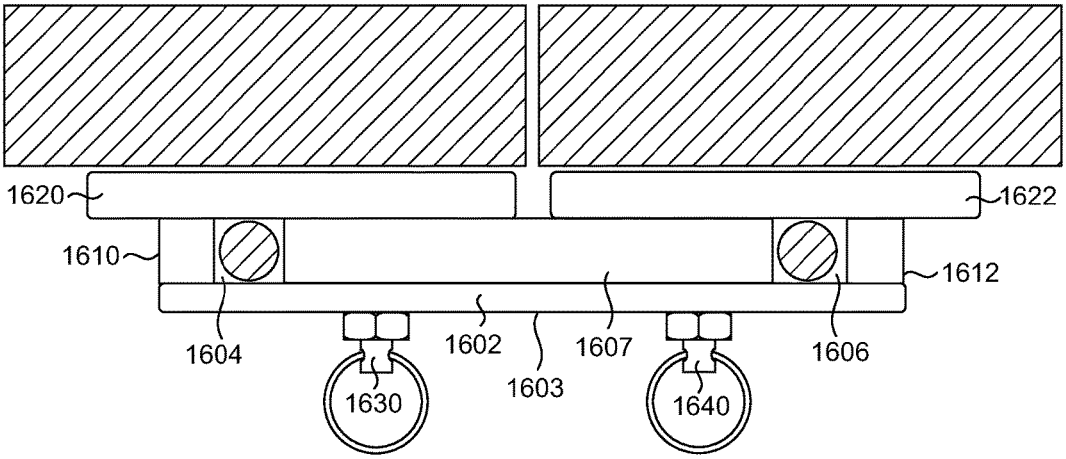
FIG. 27 illustrates a top view of the embodiment of the door clamp shown in FIG. 26 adjacent a double-door having vertical bars in a secured deployment.

FIG. 16 illustrates an isometric view of an embodiment of a door clamp in an unsecured deployment 1600 and FIG. 17 illustrates an isometric view of the embodiment of a door clamp shown in FIG. 16 in a secured deployment. FIG. 18 illustrates an actuation side view of an embodiment of a door clamp in an unsecured deployment and FIG. 19 illustrates the actuation side view of the embodiment of the door clamp shown in FIG. 18 in secured deployment. FIG. 20 illustrates a stop side view of an embodiment of a door clamp in an unsecured deployment and FIG. 21 illustrates the stop side view of the embodiment of the door clamp shown in FIG. 20 in a secured deployment. FIG. 22 illustrates a side view of an embodiment of the door clamp in an unsecured deployment and FIG. 23 illustrates the side view of the embodiment of the door clamp shown in FIG. 22 in a secured deployment. FIG. 24 illustrates a top view of an embodiment of a door clamp in an unsecured deployment and FIG. 25 illustrates the top view of the embodiment of the door clamp shown in FIG. 24 in a secured deployment. FIG. 26 illustrates a top view of an embodiment of a door clamp adjacent a double-door having vertical bars in an unsecured deployment and FIG. 27 illustrates a top view of the embodiment of the door clamp shown in FIG. 26 adjacent a double-door having vertical bars in a secured deployment.

The door clamp embodiments illustrated in FIGS. 16-27 include a base 1602 having a first surface 1603 and an opposing second surface 1605, a first longitudinal side 1607 and an opposing second longitudinal side 1608, a first end 1610, and an opposing second end 1612. The second surface 1605 includes a first groove 1604 and a second groove 1606, the first groove 1604 and the second groove 1606 being in the form of parallel slots formed in the second surface 1605 of the base 1602.

The base 1602 may be formed of a single piece or multiple pieces. For example, the embodiment illustrated in FIGS. 16 and 17 and FIGS. 24-27 illustrate a base 1602 formed of four base parts that are interconnected to form first and second grooves 1604 and 1606. In another embodiment, the base 1602 is made of one piece of material and the first and second grooves 1604 and 1606 are formed in the base 1602. The base 1602 can be made of any rigid or semi-rigid material, such as steel, aluminum or another metal, wood, or a form of plastic, for example. The first and second grooves 1604 and 1606 may be formed in the base 1602 by various methods, including casting the base with the grooves 1604 and 1606, putting multiple pieces together to form a base 1602 with grooves 1604 and 1606, or cutting the grooves 1604 and 1606 in the base 1602.

A first stop 1620 is attached to the second surface 1606 of the base 1602 and a second stop 1622 is attached to the second surface 1606 of the base 1602. In the embodiments illustrated in FIGS. 16-27, the first stop 1620 is rotatably attached left of center to the second surface 1606 (right of center when looking at the first surface 1604, as illustrated in FIGS. 16-19, for example) and the second stop 1622 is rotatably attached right of center to the second surface 1606 (left of center when looking at the first surface 1604, as illustrated in FIGS. 16-19, for example). Thus, the first stop 1620 is rotatable from the first stop first position to the first stop second position, from the first stop second position to the first stop first position and therebetween and the second stop 1622 is rotatable from the second stop first position to the second stop second position, from the second stop second position to the second stop first position and therebetween.

In other embodiments, the first stop 1620 may be slidably attached to the base 1602 to expose the first groove 1604 when placed in its first position and to cover the first groove 1604 in its second position or the first stop 1620 may be otherwise attached to or placed adjacent to the base 1602. The second stop 1622 may also be slidably attached to the base 1602 to expose the second groove 1606 when placed in its first position and to cover the second groove 1606 in its second position or the second stop 1622 may be otherwise attached to or placed adjacent to the base 1602. For example, in an embodiment, the first stop 1620 is held in its first position in which the first groove 1604 is exposed and uncovered by the first stop 1620 by the first pin 1630 when the first pin 1630 is inserted into the base 1602 and the first stop 1620 is biased to slide toward its second position where the first stop 1620 will cover the first groove 1604 when the first pin 1630 is not inserted into the base 1602 and the first stop 1620. In that embodiment, the second stop 1622 is held in its first position in which the second groove 1606 is exposed and uncovered by the second stop 1622 by the second pin 1640 when the second pin 1640 is inserted into the base 1602 and the second stop 1622 is biased to slide toward its second position where the second stop 1622 will cover the second groove 1606 when the second pin 1640 is not inserted into the base 1602 and the second stop 1620.

The first stop 1620 may be biased to rotate from approximately or substantially perpendicular to the base 1602, as illustrated in FIGS. 16, 18, 20, 22, 24, and 26 to approximately or substantially parallel to the base 1602, as illustrated in FIGS. 17, 19, 21, 23, 25, and 27. The second stop 1620 may also be biased to rotate from perpendicular to the base 1602, as illustrated in FIGS. 16, 18, 20, 22, 24, and 26, to parallel to the base 1602, as illustrated in FIGS. 17, 19, 21, 23, 25, and 27. When the stops 1620 and 1622 rotate from perpendicular to the base 1602 to parallel to the base 1602, they may do so in such a way as not to interfere with one another. For example, the first stop 1620 may be biased to rotate counterclockwise from a position that is approximately perpendicular to the base 1602 to a position that is approximately parallel to the base 1602, while the second stop 1622 may be biased to rotate clockwise from a position that is approximately perpendicular to the base 1602 to a position that is approximately parallel to the base 1602.

FIGS. 29-32 further illustrate door clamp elements that may be used to form an embodiment of the door clamp 1600.

Figure 29:
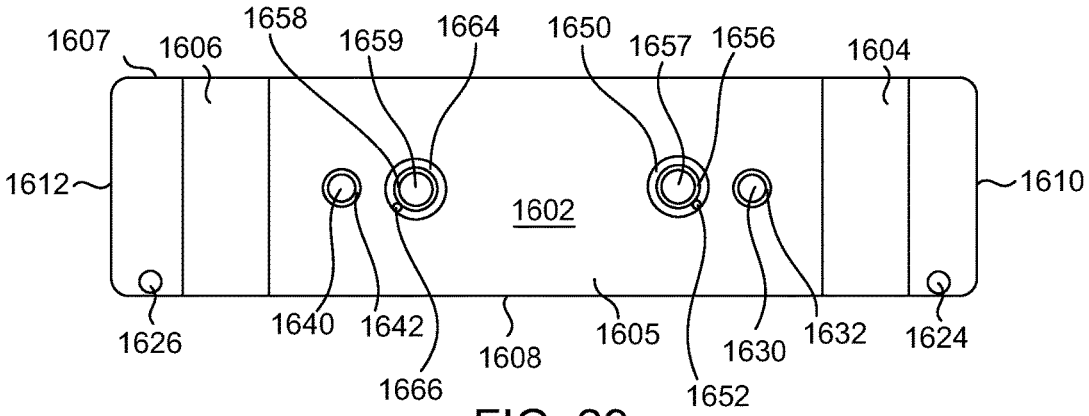
FIG. 29 illustrates a stop side view of an embodiment of a door clamp base with stop biasing depicted and no stops depicted.

FIG. 29 illustrates a stop side view of an embodiment of a door clamp base 1602 with stop biasing and no stops 1620 and 1622. The door clamp base 1602 has a first pin hole 1632, a second pin hole 1642, a first groove 1604, and a second groove 1606. A first bias 1650 is disposed on the base 1602 around a first pivot rod 1657 disposed in a first pivot rod hole 1656 and a second bias 1665 is disposed on the base 1602 around a second pivot rod 1659 disposed in a second pivot rod hole 1658.

Figure 30:
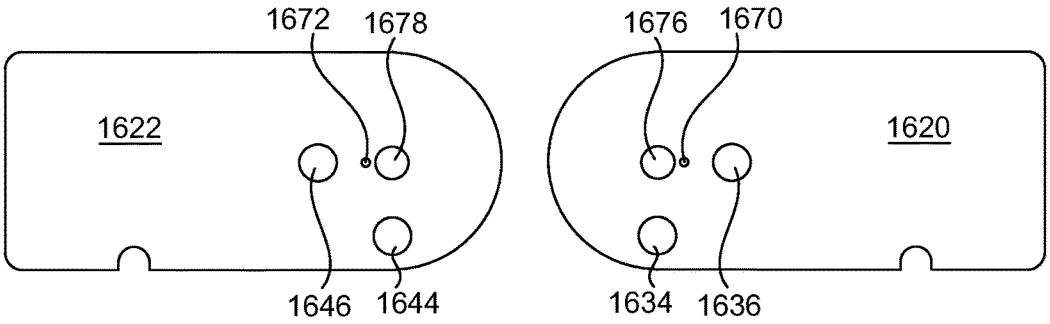
FIG. 30 illustrates an adjacent side view of a stop.

FIG. 30 illustrates view of an embodiment of the adjacent sides 1660 and 1662 first stop 1620 and the second stop 1622, respectively, as they may be placed adjacent the base 1602 illustrated in FIG. 29. The first stop 1620 includes a first stop first position pin hole 1634 and a first stop second position pin hole 1636 and the second stop 1622 includes a second stop first position pin hole 1644 and a second stop second position pin hole 1646. The first stop 1620 also includes a first stop bias retention area 1670 and the second stop 1622 includes a second stop bias retention area 1672 The bias retention areas 1670 and 1672 may retain the biases 1650 or 1665, respectively, in a desired position.

Figure 31:
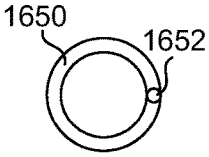
FIG. 31 illustrates an end view of a spring bias.
Figure 32:
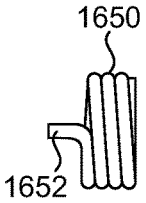
FIG. 32 illustrates a side view of the spring bias illustrated in FIG. 31.

FIG. 31 illustrates an end view of an embodiment of the first bias 1650 in a spring form and FIG. 32 illustrates a side view of the first bias 1650 in a spring form that is illustrated in FIG. 31. The first bias 1650 may be formed other than in spring form in any known way including, for example, a tube filled with a pressurized fluid, such as air. The second bias 1664 may be formed in the same way as the first bias 1650. The spring biases 1650 and 1664 are used in certain embodiments of the door clamp to bias the stops 1620 and 1622, respectively. In the embodiment illustrated in FIGS. 31 and 32, the biases 1650 and 1664 may include one or more perpendicular ends 1652 and 1666, respectively. In the embodiments illustrated in FIGS. 29 and 30, the perpendicular end 1652 of the first spring bias 1650 may be placed in the bias retention area 1670 of the first stop 1620. A similar arrangement may be used to retain the first spring 1650 in a desired orientation with regard to the base 1602.

The second bias 1664 may also have one or more perpendicular ends 1666 similar to the perpendicular end 1652 illustrated in FIGS. 31 and 32 and one of those perpendicular ends may be placed in the bias retention area 1672 of the second stop 1622. A similar arrangement may be used to retain the second spring 1664 in a desired orientation with regard to the base 1602.

Other spring retention methods and apparatuses may be used where a spring type bias 1650 or 1664 is employed, to retain the spring in a desired orientation with the base 1602 or a stop 1620 or 1622. Other biases than springs may furthermore be used to bias the stops 1620 or 1622 in relation to the base 1602.

The first pivot rod hole 1656, first stop pivot rod hole may be employed as an axis around which the first stop 1620 may rotate in an embodiment in which the first stop 1620 rotates between its first and second positions. The first pivot rod 1657 may be placed in the first pivot rod hole 1656 and may take the form of a screw, partially or fully threaded rod, smooth rod or other desired apparatus on which the first stop 1620 may rotate. The first pivot rod 1657 may extend from the first pivot rod hole 1656 in the base 1602 into a first stop pivot rod hole 1676 in the first stop 1620. Thus, in that embodiment, the first stop 1620 can pivot in relation to the base 1602 about an axis that extends through the first pivot rod hole 1656 and the first stop pivot rod hole 1676.

Similarly, the second pivot rod hole 1658 may be employed as an axis about which the second stop 1622 rotates between its first and second positions. The second pivot rod 1659 may be placed in the second pivot rod hole 1658 and may take the form of a screw, partially or fully threaded rod, smooth rod or other desired apparatus on which the second stop 1622 may rotate. The second pivot rod 1659 may extend from the second pivot rod hole 1658 in the base 1602 into a second stop pivot rod hole 1678 in the second stop 1622. Thus, in that embodiment, the second stop 1622 can pivot in relation to the base 1602 about an axis that extends through the second pivot rod hole 1658 and the second stop pivot rod hole 1678.

A first bias 1650 may be coupled to the base 1602 and the first stop 1620 in the vicinity of the first pivot rod hole 1656 and the first stop pivot rod hole 1676, respectively. Where the first bias 1650 is a spring, as is illustrated in FIGS. 31 and 32, for example, the first bias 1650 may be oriented around the first pivot rod 1657 such that the first bias 1650 biases the first stop 1620 from the first stop first position to the first stop second position.

A second bias 1664 may be coupled to the base 1602 and the second stop 1622 in the vicinity of the second pivot rod hole 1658 and the second stop pivot rod hole 1678, respectively. Where the second bias 1664 is a spring, similar to the first bias 1650 illustrated in FIGS. 31 and 32, for example, the second bias 1664 may be oriented around the second pivot rod 1659 such that the second bias 1664 biases the second stop 1622 from the second stop first position to the second stop second position.

In embodiments, the first stop 1620 may be prevented from rotating beyond its second position and the second stop 1622 may be prevented from rotating beyond its second position. For example, in one embodiment, the first stop 1620 is mechanically prevented from rotating clockwise significantly beyond perpendicular to the base 1602 and the second stop 1622 is mechanically prevented from rotating counterclockwise significantly beyond perpendicular to the base 1602.

In the embodiment illustrated in FIG. 16, it may be seen that the first stop 1620 does not cover the first groove 1604. In addition, the second stop 1622 does not cover the second groove 1606 in the embodiment illustrated in FIG. 16.

The embodiments illustrated in FIGS. 16-19 and 22-27 also include a first pin 1630 and a second pin 1640. Each of the first and second pins 1630 and 1640 may extend from the first surface 1603 through the base 1602. In an embodiment, the first pin 1630 is biased, for example, by a spring, such that it extends through the base 1602 and beyond the second surface 1605 of the base 1602 when the biasing is unactuated and so that the first pin 1630 extends into the base 1602, but not beyond the second surface 1605 when the biasing is actuated. The second pin 1640 may also be biased, for example, by a spring, such that the second pin 1640 extends through the base 1602 and beyond the second surface 1605 of the base 1602 when the biasing is unactuated and so that the second pin 1640 extends into the base 1602, but not beyond the second surface 1605 when the biasing is actuated.

It may be seen in FIG. 16 that the first pin 1630 and the second pin 1640 are in unactuated positions. In the embodiment illustrated in FIG. 16, the first pin 1630 extends through the first pin hole 1632 in the base 1602 (see also FIG. 28) into the first stop first position pin hole 1634 (see also FIG. 20), thereby retaining the first stop 1620 in its first position. Also in the embodiment illustrated in FIG. 16, the second pin 1640 extends through the second pin hole 1642 in the base 1602 into the second stop first position pin hole 1644 (see also FIG. 20).

Figure 28:
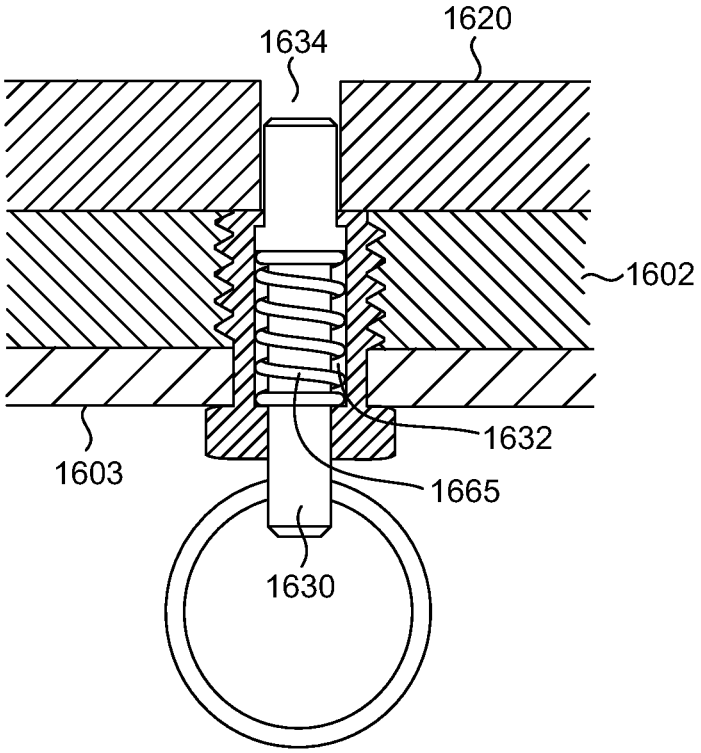
FIG. 28 illustrates an embodiment of a pin in a cutaway portion of a door clamp.

FIG. 28 illustrates an embodiment of a pin 1630 or 1640 that is biased by a spring 1665. Where the spring 1665 is adjacent the first pin 1630, the spring 1665 may be coupled to the first pin 1630 to bias the first pin 1630 to extend through the first pin hole 1632 in the base 1602 and be extendable into a pin hole in the first stop 1620, such as the first stop first position pin hole 1634 when the first stop is in its first position or the first stop second position pin hole 1636 when the first stop is in its second position. Where the spring 1665 is adjacent the second pin 1640, the spring 1665 may be coupled to the second pin 1640 to bias the second pin 1640 to extend through the second pin hole 1642 in the base 1602 and be extendable into a pin hole in the second stop 1622, such as the second stop first position pin hole 1644 when the second stop is in its first position, or the second stop second position pin hole 1646 when the second stop is in its second position.

In an embodiment, the first and second pins 1630 and 1640 may be formed similarly to the holding pin 170 described hereinbefore and illustrated in the figures, including FIG. 1.

Actuation of the first and second pins 1630 and 1640 may be accomplished in one embodiment by manually pulling the pin 1630 or 1640 from the first side 1603 of the base 1602. Actuation of the first pin 1630 may release the first stop 1620 such that the first stop 1620 may move from its first position to its second position, from its second position to its first position, or from any position to any other desired position. Actuation of the second pin 1640 may release the second stop 1622 such that the second stop 1622 may move from its first position to its second position, from its second position to its first position, or from any position to any other desired position.

FIG. 17 illustrates an isometric view of the embodiment of a door clamp shown in FIG. 16 in a secured deployment. In FIG. 17, it may be seen that the first stop 1620 covers the first groove 1604 and the second stop 1622 covers the second groove 1606. It may be seen in FIG. 17 that the first pin 1630 and the second pin 1640 are in unactuated positions. In the embodiment illustrated in FIG. 17, the first pin 1630 extends through the first pin hole 1632 in the base 1602 into the first stop second position pin hole 1636 (see also FIG. 21), thereby retaining the first stop 1620 in its second position. Also in the embodiment illustrated in FIG. 17, the second pin 1640 extends through the second pin hole 1642 in the base 1602 into the second stop second position pin hole 1646 (see also FIG. 21), thereby retaining the second stop 1622 in its second position.

FIGS. 18 and 19 illustrate an embodiment of a door clamp similar to the embodiment illustrated in FIGS. 16 and 17. FIG. 18 illustrates an actuation side view of the door clamp in an unsecured deployment with the first stop 1620 in its first position, in this embodiment approximately perpendicular to the base 1602, such that the first groove 1604 is open and uncovered by the first stop 1620. The second stop 1620 illustrated in FIG. 18 is also in its first position, in this embodiment approximately perpendicular to the base 1602, such that the second groove 1606 is also open and uncovered by the second stop 1622.

FIG. 19 illustrates the actuation side view of the embodiment of the door clamp shown in FIG. 18 in secured deployment. In the secured deployment, the first stop 1620 is in its second position, in this embodiment approximately parallel to the base 1602, such that the first groove 1604 is closed and covered by the first stop 1620. The second stop 1620 illustrated in FIG. 19 is also in its second position, in this embodiment approximately parallel to the base 1602, such that the second groove 1606 is closed and covered by the second stop 1622.

A first obstruction 1624 and a second obstruction 1626 are included in the door clamp embodiment illustrated in FIGS. 20 and 21. The first obstruction 1624 may be positioned on the base 1602 to prevent over rotation of the first stop 1620. The first obstruction 1624 may operate such that the first stop 1620 contacts the first obstruction 1624, thereby ceasing rotation of the first stop 1620 such that the first stop 1620 covers the first groove 1604 in the base 1602. In the embodiment illustrated in FIG. 21, for example, the first stop 1620 impinges upon the first obstruction 1624, at which point the first obstruction 1624 stops rotation of the first stop 1620 in a position where the first stop 1620 is nearly, approximately, or substantially parallel with the base 1602.

The second obstruction 1626 may be positioned on the base 1602 to prevent over rotation of the second stop 1622. The second obstruction 1626 may operate such that the second stop 1622 contacts the second obstruction 1626, thereby ceasing rotation of the second stop 1622 such that the second stop 1622 covers the second groove 1606 in the base 1602. In the embodiment illustrated in FIG. 21 the second obstruction 1626, at which point the second obstruction 1626 stops rotation of the second stop 1622 in a position where the second stop 1622 is nearly, approximately, or substantially parallel with the base 1602.

The first stop 1620 or second stop 1622 may be shaped such that they contact the first or second obstruction 1624 and 1626 in a desired position, as is shown in FIG. 21. For example, the embodiment illustrated in FIGS. 20 and 21 include a first stop 1620 with a notch that permits the first stop 1620 to move to a position in which the first stop 1620 is approximately parallel to the base 1602 when the first stop 1620 contacts the first obstruction 1624. Similarly, in the embodiment illustrated in FIGS. 20 and 21, the second stop 1622 includes a notch that permits the second stop 1622 to move to a position in which the second stop 1622 is approximately parallel to the base 1602 when the second stop 1622 contacts the second obstruction 1626. In other embodiments, obstructions 1624 and 1626 may be formed or positioned differently or no obstructions may be used.

The embodiments illustrated in FIGS. 22 through 25 illustrate side and top views of embodiments of door clamps. The embodiments illustrated in FIGS. 22 and 24 illustrate pins 1630 and 1640 in an actuated position in which the pins 1630 and 1640 extend into the base 1602, but do not extend into the first or second stops 1620 and 1622. Other depictions of the pins 1630 and 1640, including those shown in the embodiments illustrated in FIGS. 16, 17, 23, and 25 illustrate the pins 1630 and 1640 in unactuated positions in which the pins 1630 and 1640 extend through the base 1602 and into the first and second stops 1620 and 1622, respectively.

FIGS. 26 and 27 illustrate top views of the door stop embodiment illustrated in FIGS. 24 and 25, respectively, in use when securing double-doors having parallel bars. As may be seen in FIG. 26, the door clamp 1600 is placed such that a bar attached to the first door is situated in the first groove 1604 and a bar attached to the second door is situated in the second groove 1606 with the first stop 1620 in its first position such that the first groove 1604 is open and uncovered and with the second stop 1622 in its first position such that the second groove 1606 is open and uncovered. The first stop 1620 and the second stop 1622 may then be actuated, for example by pulling the pins 1630 and 1640 respectively.

FIG. 27 illustrates the door clamp of FIG. 26 with the first stop 1620 in its second position and the second stop 1622 in its second position. When the first stop 1620 is in its second position in this embodiment, the first stop 1620 and the base 1602 capture the bar attached to the first door in the first groove 1604, as shown. Similarly, when the second stop 1622 is in its second position in this embodiment, the second stop 1622 and the base 1602 capture the bar attached to the second door in the second groove 1606. With the first and second bars captured by the door clamp 1600, the first and second doors are held together so that they cannot be opened.

By covering the grooves 1604 and 1606 with the stops 1620 and 1622, parallel bars, such as those found on many double-doors, may be enclosed in the grooves 1604 and 1606 by the stops 1620 and 1622. Thus, an embodiment, the door clamp embodied in FIGS. 24-27 may be placed such that the first and second grooves 1604 and 1606 are adjacent parallel bars on each of two adjacent or double-doors with the stops 1620 and 1622 in their first positions, as illustrated in FIG. 26. The first and second stops 1620 and 1622 may then be moved to their second positions, for example by actuating the first and second pins 1630 and 1640, so that the first and second stops 1620 and 1622 capture the parallel bars of the double-doors in the first and second grooves 1604 and 1606. Where, for example, the double-doors are arranged with one of the parallel bars on each door, which is common, for example, where the parallel bars of the doors are used to lock the doors into the ceiling or floor, it may be that the doors cannot be opened when the door clamp is arranged with the parallel bars secured in the grooves 1604 and 1606 with the stops 1620 and 1622 in their second positions in which the stops 1620 and 1622 cover the grooves 1604 and 1606, respectively.

As may be seen in the embodiments illustrated in FIGS. 20, 22, 24, and 26, for example, the first groove 1604 may be exposed when the first stop 1620 is placed in its first position, a position that may be achieved when the first stop 1620 is rotated to approximately perpendicular to the base 1602. Similarly, the second groove 1606 may be exposed when the second stop 1622 is placed in its first position, a position that may be achieved when the second stop 1622 is rotated to approximately perpendicular to the base 1602, as may be seen in the embodiments illustrated in FIGS. 20, 22, 24, and 26.

FIGS. 21, 23, 25, and 27 illustrate embodiments of the door clamping device with the first stop 1620 and the second stop 1622 in their second positions. In their second positions, the first stop 1620 and the second stop 1622 in those embodiments cover the first groove 1604 and the second groove 1606, respectively, in the base 1602. In those embodiments, the first groove 1604 is covered by the first stop 1620 when the first stop is rotated from its first position, which may be nearly perpendicular to the base 1602 as illustrated in FIG. 20, for example, to its second position, which may be nearly parallel to the base 1602 as illustrated in FIG. 21, for example. The second stop 1622 similarly covers the second groove 1606 when the second stop 1622 is rotated from its first position, which may be nearly perpendicular to the base 1602 as illustrated in FIG. 20, for example, to its second position, which may be nearly parallel to the base 1602 as illustrated in FIG. 21, for example.

In operation, the first stop 1620 may be held in its first position by the first pin 1630. The first position for the first stop 1620 is one in which the first groove 1604 is exposed, not covered by the first stop 1620, (an embodiment of which is illustrated, for example, in FIGS. 16 and 20). The first position, in an embodiment, positions a rotatable first stop 1620 approximately perpendicular to the base 1602.

The first pin 1630 may retain the first stop 1620 in its first position by extending through a first pin hole 1632 in the base 1602 and into a first stop first position pin hole 1634 in the first stop 1620. The first stop first position pin hole 1634 may extend into and through the first stop 1620 or may extend into the adjacent side 1660 of the first stop 1620 that is adjacent the base 1602 without extending through the first stop 1620.

The first stop 1620 may be moved from its first position in which the first groove 1604 is not covered by the first stop 1620 (an embodiment of which is illustrated, for example, in FIGS. 16 and 20), to its second position in which the first groove 1604 is covered by the first stop 1620 (an embodiment of which is illustrated, for example, in FIGS. 17 and 21) by initially pulling the first pin 1630 out of the first stop first position pin hole 1634. The base 1602 may retain the first pin 1630 engaged therewith when the first pin 1630 is removed from the first stop 1620. The first stop 1620 may then be moved to the second position. Where the first stop 1620 is biased toward the second position, the first stop 1620 may move to the second position under the power of the first bias 1650 (see also FIGS. 29-32). Furthermore, where the first pin 1630 is biased toward the first stop 1620, the first pin 1630 may, but does not necessarily, contact or press against the adjacent side 1660 of the first stop 1620 as the first stop 1620 moves to its second position.

In an embodiment, a first stop second position pin hole 1636 extends into and may pass through the first stop 1620. In that embodiment, the first pin 1630 may extend into the first stop second position pin hole 1636, thereby maintaining the first stop 1620 in its second position. In such an embodiment, the first obstruction 1624 may not be employed.

Similarly, the second stop 1622 may be held in its first position (an embodiment of which is illustrated, for example, in FIGS. 16 and 20) by the second pin 1640. The second pin 1640 may retain the second stop 1622 in its first position, which may be approximately perpendicular to the base 1602, by extending through a second pin hole 1642 in the base 1602 and into a second stop first position pin hole 1644 in the second stop 1622. The second stop first position pin hole 1644 may extend into and through the second stop 1622 or may extend into the adjacent side 1662 of the second stop 1622 that is adjacent the base 1602 without extending through the second stop 1622.

The second stop 1622 may be moved from its first position in which the second groove 1606 is not covered by the second stop 1622 (an embodiment of which is illustrated, for example, in FIGS. 16 and 20), to its second position in which the second groove 1606 is covered by the second stop 1622 (an embodiment of which is illustrated, for example, in FIGS. 17 and 21) by initially pulling the second pin 1640 out of the second stop first position pin hole 1644. The base 1602 may retain the second pin 1640 engaged therewith when the second pin 1640 is removed from the second stop 1622. The second stop 1622 may then be moved to the second position. Where the second stop 1622 is biased toward the second position, the second stop 1622 may move to its second position under the power of the second bias 1664 (see also FIGS. 29-32). Furthermore, where the second pin 1640 is biased toward the second stop 1622, the second pin 1640 may, but does not necessarily, contact or press against the adjacent side 1662 of the second stop 1622 as the second stop 1622 moves to its second position.

In an embodiment, a second stop second position pin hole 1646 extends into and may pass through the second stop 1622. In that embodiment, the second pin 1640 may extend into the second stop second position pin hole 1646, thereby maintaining the second stop 1622 in its second position. In such an embodiment, the second obstruction 1626 may not be employed.

A method of using the door clamp includes placing the base 1602 of the door clamp such that a first bar of a first door of a set of double-doors is adjacent the first groove 1604 in the base 1602 and a second bar of a second door of the set of double-doors is adjacent the second groove 1606 in the base 1602. The first stop 1620 is then moved to its second position in which it covers the first groove 1604, thereby capturing the first bar in the first groove 1620. The second stop 1622 is also moved to its second position in which it covers the second groove 1606, thereby capturing the second bar in the second groove 1622.

In certain embodiments, the first stop 1620 is moved from its first position to its second position by pulling the first pin 1630 and the second stop 1622 is moved from its first position to its second position by pulling the second pin 1640. In one such embodiment, the first stop 1620 is manually moved from its first position to its second position by the operator. The second stop 1622 may also be moved from its first position to its second position by the operator.

In another embodiment, the first stop 1620 moves from its first position to its second position under power provided by the first bias 1650 when the first pin 1630 is removed from the first stop 1620, for example the first stop first position pin hole 1634. In that embodiment, the second stop 1622 may move from its first position to its second position under power provided by the second bias 1664 when the second pin 1640 is removed from the second stop 1622, for example the second stop first position pin hole 1644.

After the first stop 1620 moves from its first position to its second position, the first pin 1630 may be inserted through the first pin hole 1630 in the base 1602 into the first stop second position pin hole 1636. Placing the first pin 1630 through the first pin hole 1632 and into the first stop second position pin hole 1636 may retain the first stop 1620 in its second position.

Similarly, after the second stop 1622 moves from its first position to its second position, the second pin 1640 may be inserted through the second pin hole 1640 in the base 1602 into the second stop second position pin hole 1646. Placing the second pin 1640 through the second pin hole 1642 and into the second stop second position pin hole 1646 may retain the second stop 1622 in its second position.

In embodiments wherein the first pin 1630 is biased (see example illustrated in FIG. 28, for example), the first pin 1630 may enter the first stop second position pin hole 1636 under the power of the biasing when the first stop 1620 reaches its second position. Similarly, where the second pin 1640 is biased (see example illustrated in FIG. 28, for example), the second pin 1640 may enter the second stop second position pin hole 1646 under the power of the biasing when the second stop 1622 reaches its second position. Thus, where the first and second pins 1630 and 1640 are biased to extend through the base 1602 into the first and second stops 1620 and 1622, respectively, and the first and second stops 1620 and 1622 are pinned in their first positions and biased toward their second positions, the door clamp can be activated simply by placing the door clamp with the first and second grooves 1604 and 1606 over first and second bars of double-doors and pulling then releasing the first and second pins 1630 and 1640, thereby permitting the first and second stops 1620 and 1622 to move from their first positions to their second positions and be locked by pinning in their second positions, thereby capturing the first and second bars in the first and second grooves 1604 and 1606, respectively.

The first obstruction 1624 may stop movement of the first stop 1620 in a position where the first stop 1620 covers the first groove 1604. The second obstruction 1626 may stop movement of the second stop 1622 in a position where the second stop 1622 covers the second groove 1606. In that way, a bar on a first door or other apparatus may be trapped in the first groove 1604 between the base 1602 and the first stop 1620 and a second bar on a second door or other apparatus may be trapped in the second groove 1606 between the base 1602 and the second stop 1622 as is illustrated in FIG. 27.

While the present invention has been disclosed with reference to certain embodiments, numerous modifications, alterations, and changes to the described embodiments are possible without departing from the scope of the present invention, as defined in the appended claims. Accordingly, it is intended that the present invention not be limited to the described embodiments, but that it have the full scope defined by the language of the following claims, and equivalents thereof.

What is claimed is:

1. A door clamping device comprising:

a stop having a width dimensioned to fit under a closed door such that the stop can be slid from an inner side of the door, under the door, and past an outer side of the door when positioned horizontally and the stop having a length adapted to extend along a surface of the door when the stop is positioned vertically so that the stop is positionable to abut the outer side of the door;

a base having a first end and a second end, the first end fixedly attached to the stop, the base having a cross-section that, at its widest diameter, fits under the closed door and rotates under the closed door;

a jamb bracket fixedly attached to the second end of the base and dimensioned such that the jamb bracket extends along a surface of a door frame adjacent the inner side of the closed door when the stop is positioned vertically; and a fastener coupled to the jamb bracket to extend into a fastener hole in a floor adjacent the door when the jamb bracket is adjacent the door frame.

2. The door clamping device of claim 1, wherein the base has a length from the first end to the second end and wherein the stop is fixedly attached to the first end of the base at a substantially right angle.

3. The door clamping device of claim 2, wherein the jamb bracket is fixedly attached to the second end of the base at a substantially right angle perpendicular to the stop.

4. The door clamping device of claim 1, wherein the fastener is threaded through the jamb bracket.

5. The door clamping device of claim 4, wherein the fastener includes a threaded pin having a spring-loaded plunger extending therethrough, the spring-loaded plunger for extending into a fastener hole.

6. The door clamping device of claim 1, wherein the base is configured to extend under the closed door, the stop is configured to extend vertically adjacent to an outer side of the closed door, the jamb bracket is configured to extend along a door jamb on an inner side of the door, and the fastener is configured to extend through the jamb bracket into the fastener hole in the floor adjacent the door.

7. The door clamping device of claim 1, further comprising a bracket attached to the floor adjacent the closed door, the bracket having a fastener hole, wherein the fastener extends into the fastener hole in the bracket when the jamb bracket is adjacent the door frame.

8. The door clamping device of claim 7 wherein the bracket is attached to the floor adjacent the closed door by one or more screws.

9. A door clamping device comprising:

a stop having a width dimensioned to fit under a closed door such that the stop can be slid under the door when positioned horizontally and the stop having a length adapted to extend along a surface of the door when positioned vertically so that the stop is positionable to abut the surface of the door;

a base having a first end and a second end, the first end fixedly attached to the stop, the base having a cross-section that, at its widest diameter, fits under the closed door and is adapted to be rotated under the closed door;

a jamb bracket fixedly attached to the second end of the base and dimensioned such that the jamb bracket extends along a surface of a door frame adjacent the inner side of the closed door when the stop is positioned vertically;

a fastener coupled to the jamb bracket to extend into a fastener hole when the jamb bracket extends along the surface of the door frame adjacent the inner side of the closed door; and a fastener bracket, the fastener bracket attachable to a floor adjacent the closed door by the fastener being insertable into a hole in the floor, wherein the fastener hole is in the fastener bracket and the fastener extends into the fastener hole in the fastener bracket when the jamb bracket extends along the surface of the door frame adjacent the inner side of the closed door.

10. The door clamping device of claim 9, wherein the base has a length from the first end to the second end and wherein the stop is fixedly attached to the first end of the base at a substantially right angle; and wherein the jamb bracket is fixedly attached to the second end of the base at a substantially right angle perpendicular to the stop.

11. The door clamping device of claim 10, wherein the base is configured to extend under the closed door, the stop is configured to extend vertically adjacent to an outer side of the closed door, the jamb bracket is configured to extend along a door jamb on an inner side of the closed door, and the fastener is configured to extend through the jamb bracket into the fastener hole.

* * * * *